US010470573B1

(12) United States Patent
Smith et al.

(10) Patent No.: US 10,470,573 B1
(45) Date of Patent: Nov. 12, 2019

(54) TRAY WITH SUPPORT ARM

(71) Applicant: Sub-Zero, Inc., Madison, WI (US)

(72) Inventors: Terence Thomas Smith, Lake Mills, WI (US); Curtis Leroy Cruver, IV, Elmhurst, IL (US)

(73) Assignee: SUB-ZERO, INC., Madison, WI (US)

( * ) Notice: Subject to any disclaimer, the term of this patent is extended or adjusted under 35 U.S.C. 154(b) by 0 days.

(21) Appl. No.: 16/299,433

(22) Filed: Mar. 12, 2019

(51) Int. Cl.
*A47B 88/975* (2017.01)
*A47B 88/40* (2017.01)
*A47B 63/00* (2006.01)

(52) U.S. Cl.
CPC ..... *A47B 88/975* (2017.01); *A47B 88/40* (2017.01); *A47B 63/00* (2013.01)

(58) Field of Classification Search
CPC ..... A47B 88/40; A47B 63/00; A47B 88/975
USPC ..... 211/184, 10, 11, 126.13, 169, 171; 220/531, 529; 108/60, 61; 312/35
See application file for complete search history.

(56) References Cited

U.S. PATENT DOCUMENTS 409,730 A * 8/1889 Brown ..... B42F 17/08 211/11
423,647 A * 3/1890 Wells ..... B24F 17/08 211/11
451,729 A * 5/1891 Dom ..... B42F 17/12 211/11
679,474 A * 7/1901 Early ..... A47B 57/04 108/1
807,084 A * 12/1905 Muller ..... B42F 17/08 211/11
1,096,936 A * 5/1914 Moore ..... B42F 17/08 211/11
1,106,265 A * 8/1914 Whittle ..... B42F 17/00 206/565
1,119,925 A * 12/1914 Chatham ..... B42F 17/00 211/11
1,277,827 A * 9/1918 Barber ..... A47C 29/006 135/137
1,456,446 A * 5/1923 Hotaling ..... A47F 7/148 211/181.1
1,677,544 A * 7/1928 Gourley ..... A47B 88/90 312/117
1,692,231 A * 11/1928 Thompson ..... B42F 17/02 211/11
1,814,191 A * 7/1931 Seyl ..... B42F 17/02 211/51

(Continued)

*Primary Examiner* — Jonathan Liu
*Assistant Examiner* — Devin K Barnett
(74) *Attorney, Agent, or Firm* — Bell & Manning, LLC

(57) ABSTRACT

A tray includes support arms and a base. Each support arm includes a top arm portion, a right hook, a right fulcrum portion mounted between the top arm portion and the right hook, a left hook, and a left fulcrum portion mounted between the top arm portion and the left hook. The base includes a base top plate that includes a right fulcrum platform, a left fulcrum platform, and a spring for each support arm. The right fulcrum portion is mounted to rotate on the right fulcrum platform. The left fulcrum portion is mounted to rotate on the left fulcrum platform. The spring is positioned to contact at least one of the right hook or the left hook when the associated support arm rotates on the right fulcrum platform and on the left fulcrum platform. The spring supports the top arm portion in an approximately upright position.

20 Claims, 23 Drawing Sheets

(56) References Cited

U.S. PATENT DOCUMENTS 1,851,662 A * 3/1932 Casey ..... B42F 17/08 211/11
1,952,118 A * 3/1934 Casey ..... B42F 17/08 211/11
2,010,740 A * 8/1935 Straubel ..... B42F 17/02 220/531
2,062,802 A * 12/1936 Walker ..... A47F 7/175 211/11
D124,197 S * 12/1940 Lynch ..... D7/409
2,231,633 A * 2/1941 Metzger ..... B42F 17/18 211/11
2,233,938 A * 3/1941 Jones ..... B42F 17/02 220/529
2,289,070 A * 7/1942 Ralston ..... B42F 17/08 211/11
2,360,026 A * 10/1944 Wall ..... A47J 37/0694 126/337 R
2,828,178 A * 3/1958 Dahlgren ..... F25D 23/04 312/321.5
2,873,860 A * 2/1959 Holloway ..... A47B 63/02 211/50
2,956,685 A * 10/1960 Levi ..... A47B 81/067 211/40
3,084,617 A * 4/1963 Jamentz ..... A47J 37/0694 108/3
3,144,942 A * 8/1964 Peebles ..... B42F 17/08 211/11
3,200,958 A * 8/1965 Hudgeons, Sr. ..... A47F 5/0087 211/169
3,269,547 A * 8/1966 Chamberlin ..... A47B 57/58 108/60
3,295,696 A * 1/1967 Cohen ..... A47F 7/10 211/171
3,554,381 A * 1/1971 Guest ..... B42F 17/02 206/565
3,559,815 A * 2/1971 Huddleston ..... A47F 5/005 211/184
3,812,975 A * 5/1974 Gutierrez ..... B42F 17/02 211/11
3,869,045 A * 3/1975 Lear ..... B42F 17/02 211/11
4,023,682 A * 5/1977 Niece ..... A47B 57/581 108/27
4,084,699 A * 4/1978 Koepke ..... B42F 17/12 211/11
4,087,926 A * 5/1978 Breslau ..... G03D 13/125 211/50
4,241,921 A * 12/1980 Miller ..... A63F 3/06 211/11
4,461,388 A * 7/1984 Bustos ..... A47F 7/28 211/184
4,512,480 A * 4/1985 Evenson ..... B42F 17/12 108/60
4,593,822 A * 6/1986 Yeaney ..... A61L 2/26 211/41.8
4,682,697 A * 7/1987 Cohen ..... A47F 7/163 211/133.2
4,700,640 A * 10/1987 Andersson ..... A01C 15/006 111/170
5,111,959 A * 5/1992 Glickman ..... A47B 88/90 220/544
5,115,919 A * 5/1992 Dorman ..... B42F 17/12 211/184
5,152,405 A * 10/1992 Schriner ..... B42D 5/005 206/214
D341,523 S * 11/1993 Tiemann ..... D7/409
D364,074 S * 11/1995 Yeh ..... D6/678.4
5,662,228 A * 9/1997 Mendoza ..... G09B 23/30 108/28
5,738,019 A * 4/1998 Parker ..... A47B 46/00 108/108
6,065,610 A * 5/2000 Elmore ..... B07C 7/04 211/10
6,116,153 A * 9/2000 Burrows ..... F24C 15/16 99/426
6,220,684 B1 * 4/2001 Bent ..... A47B 96/02 211/88.01
6,227,384 B1 * 5/2001 Saylor ..... A47B 17/033 211/11
6,516,927 B2 * 2/2003 Krulik ..... A45C 3/02 150/114
6,826,858 B1 * 12/2004 Muller ..... A47G 1/17 211/169
D500,803 S * 1/2005 Stravitz ..... D19/75
D502,220 S * 2/2005 Stravitz ..... D19/75
D504,702 S * 5/2005 Stravitz ..... D19/90
7,086,538 B2 * 8/2006 Stravitz ..... B42F 17/20 211/11
D534,374 S * 1/2007 Wright ..... D6/566
7,296,697 B2 * 11/2007 Costa ..... A47B 47/022 211/175
D585,094 S * 1/2009 Smith ..... D19/90
7,497,533 B2 * 3/2009 Remmers ..... A47B 57/42 108/108
7,669,523 B1 * 3/2010 Zemel ..... A47J 37/0694 99/425
D629,251 S * 12/2010 Tiemann ..... D7/402
7,950,537 B1 * 5/2011 Goodman ..... A47B 57/581 211/184
D668,103 S * 10/2012 Cloutier ..... D7/402
D694,580 S * 12/2013 Cloutier ..... D7/402
8,596,205 B2 * 12/2013 Driver ..... A47B 95/043 108/27
8,627,764 B1 * 1/2014 Cloutier ..... A47J 37/0694 99/448
8,925,745 B2 * 1/2015 Theisen ..... F21V 33/00 211/10
9,226,577 B2 * 1/2016 Stepp ..... A47B 81/005
9,320,354 B2 * 4/2016 Yoshikawa ..... A47B 61/04
9,596,931 B1 * 3/2017 Nimgulkar ..... A47B 88/49
2003/0025424 A1 2/2003 Graves
2004/0050811 A1 * 3/2004 Leahy ..... A47F 5/0043 211/134
2005/0011846 A1 * 1/2005 Stein ..... A47F 5/02 211/169
2005/0016939 A1 * 1/2005 Eby ..... A47F 7/14 211/11
2005/0133468 A1 * 6/2005 Stravitz ..... B42F 17/20 211/11
2005/0161418 A1 * 7/2005 Lynch ..... A47F 5/0056 211/119.003
2005/0173355 A1 * 8/2005 Stravitz ..... B42F 17/20 211/11
2006/0096938 A1 * 5/2006 Kanou ..... A47F 3/0486 211/184
2007/0029270 A1 * 2/2007 Hawkinson ..... A47F 1/126 211/59.3
2007/0046160 A1 * 3/2007 Egan ..... A47B 96/02 312/408
2007/0247037 A1 * 10/2007 Schenker ..... A47B 88/00 312/223.6
2009/0065452 A1 * 3/2009 Smith ..... B42F 17/12 211/11
2010/0078402 A1 * 4/2010 Davis ..... A47B 57/585 211/184
2010/0102689 A1 * 4/2010 Chambers ..... A47B 88/48 312/257.1
2010/0206829 A1 * 8/2010 Clements ..... A47F 1/12 211/162
2010/0307998 A1 * 12/2010 Chen ..... A47B 96/021 211/184
2013/0020270 A1 * 1/2013 Valiulis ..... A47F 5/005 211/59.2
2013/0134169 A1 * 5/2013 Michaels ..... A47G 19/2205 220/505
2013/0307394 A1 * 11/2013 Dondurur ..... A47B 88/975 312/348.3

(56) References Cited

U.S. PATENT DOCUMENTS

| | | | | |
|---|---|---|---|---|
| 2014/0263111 | A1* | 9/2014 | Micek | A47L 19/04 211/41.6 |
| 2015/0076086 | A1* | 3/2015 | Tsai | B42F 7/10 211/11 |
| 2015/0136718 | A1* | 5/2015 | Sabounjian | A47J 31/3642 211/85.4 |
| 2015/0151877 | A1* | 6/2015 | Gallanosa, II | B65D 25/06 220/531 |
| 2018/0344029 | A1* | 12/2018 | Miles | A47B 88/975 |

* cited by examiner

TRAY WITH SUPPORT ARM

BACKGROUND

Many trays, shelves, and bins have static partitions, but not flexible partitions to support objects.

SUMMARY

In an example embodiment, a tray is provided that includes, but is not limited to, a plurality of support arms and a base. Each support arm of the plurality of support arms includes, but is not limited to, a top arm portion, a right hook, a right fulcrum portion mounted between the top arm portion and the right hook, a left hook, and a left fulcrum portion mounted between the top arm portion and the left hook. The base includes, but is not limited to, a base top plate. The base top plate includes, but is not limited to, a right fulcrum platform, a left fulcrum platform, and a spring for each support arm of the plurality of support arms. The right fulcrum portion of the associated support arm is mounted to rotate on the right fulcrum platform. The left fulcrum portion of the associated support arm is mounted to rotate on the left fulcrum platform. The spring is positioned to contact at least one of the right hook or the left hook of the associated support arm when the associated support arm rotates on the right fulcrum platform and on the left fulcrum platform. The spring supports the top arm portion in an approximately upright position.

In another example embodiment, a shelving system is provided that includes, but is not limited to, a ladder, a shelf, and the tray. The shelf includes, but is not limited to, a shelf plate and a shelf bracket mounted to the shelf plate and to the ladder, wherein the tray is mounted to the shelf.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
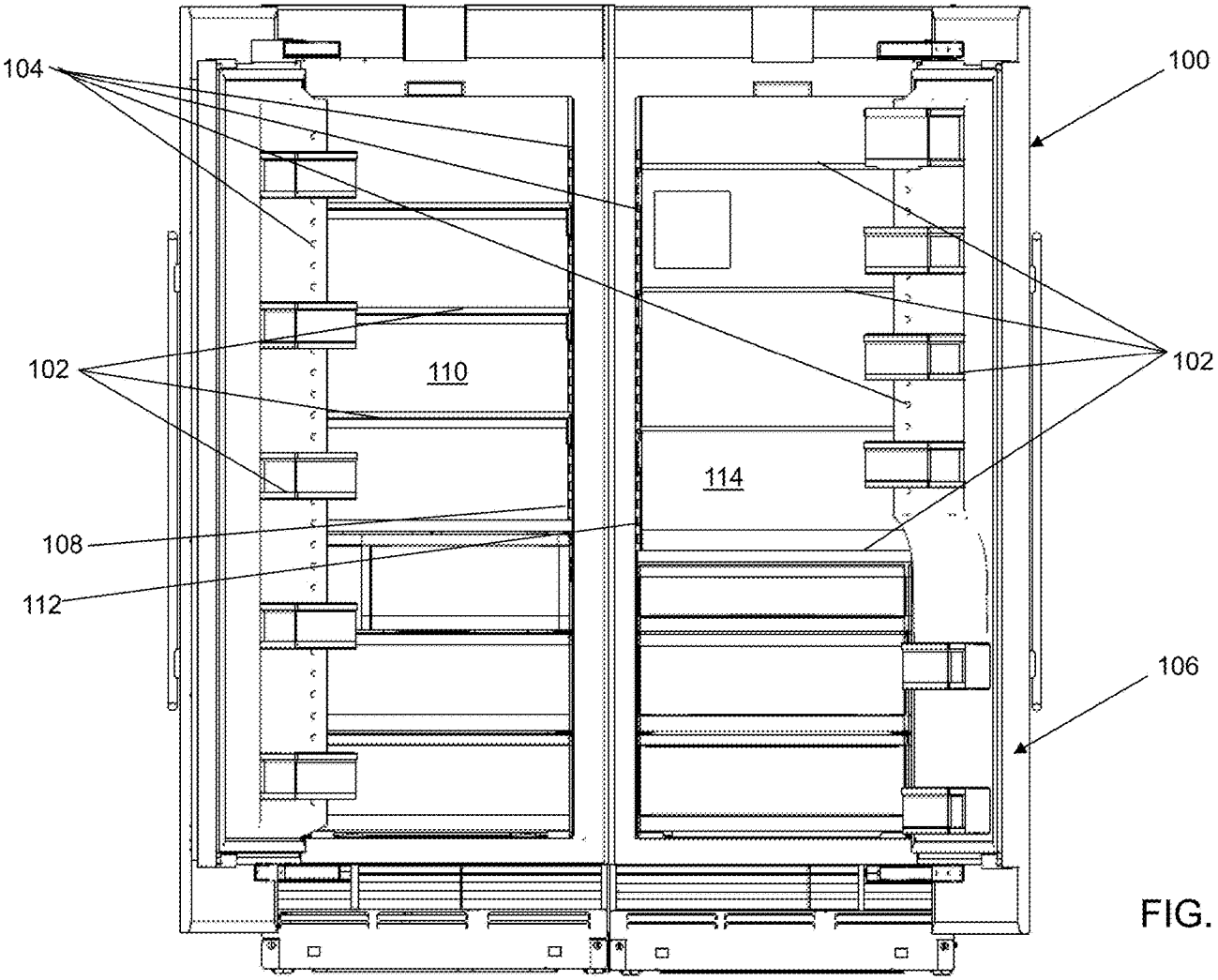
FIG. 1 depicts a device in which a plurality of shelves is mounted in accordance with an illustrative embodiment.

Referring to FIG. 1, an illustrative device is shown in which a plurality of shelves 102 is mounted. FIG. 1 shows a front view of a refrigerator 100 with open doors to show a portion of two interior spaces that include the plurality of shelves 102. The plurality of shelves 102 are mounted to a plurality of ladders 104 not all of which are visible. The plurality of ladders 104 may be mounted to one or more walls that define each interior space including a door 106 that may enclose the interior space. One or more ladders of the plurality of ladders 104 may be used to mount each shelf of the plurality of shelves 102. For example, a first left ladder (not shown) and a first right ladder 108 may be mounted to a first back wall 110 to extend vertically near a left edge and near a right edge of first back wall 110, respectively. A second left ladder 112 and a second right ladder (not shown) may be mounted to a second back wall 114 to extend vertically near a left edge and near a right edge of second back wall 114, respectively.

A ladder may be mounted in other locations and to other walls that define the interior space. For example, in an alternative embodiment, the ladder may extend horizontally or in another direction. As another example, the ladder may be mounted at a center of the back wall or to a side wall. As yet another example, the ladder(s) may be mounted to door 106. A drawer or other storage space may further be mounted to the shelf. The shelf may be included in a heated or a cooled space or in a space at an ambient temperature. The cooled space, for example, may be a refrigerated space or a freezer space. One or more of the plurality of shelves 102 may extend a portion of a width and/or a depth of the interior space or an entire width and/or an entire depth of the interior space. One or more of the plurality of shelves 102 further may extend a portion of a width of door 106 or an entire width of door 106. Refrigerator 100 may include one or more compressors, one or more evaporators, one or more condensers, one or more dryers, one or more fans, etc. to control cooling of the interior spaces as understood by a person of skill in the art.

Figure 2A:
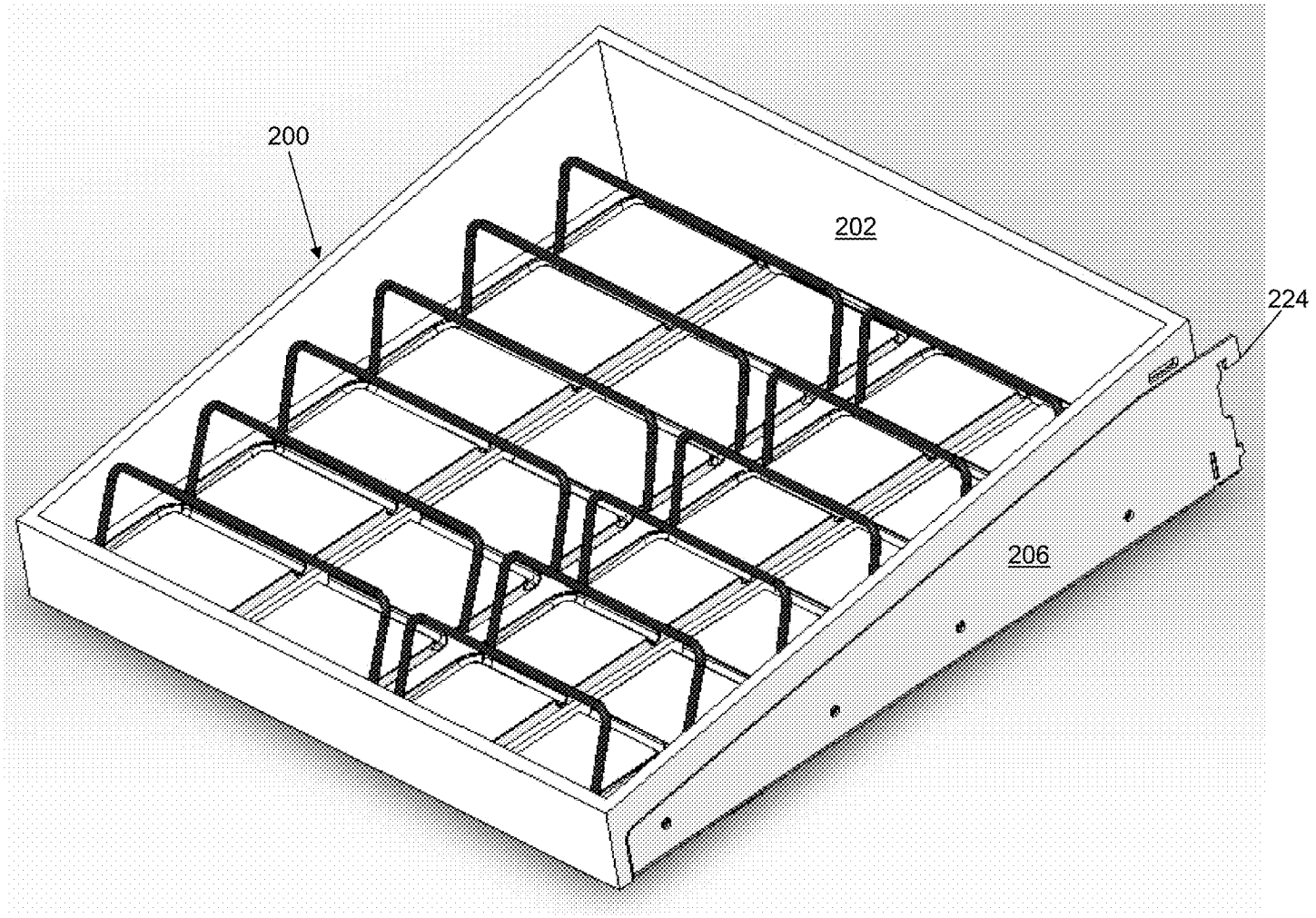
FIG. 2A depicts a front perspective view of a shelf of the plurality of shelves of FIG. 1 in accordance with an illustrative embodiment.
Figure 2B:
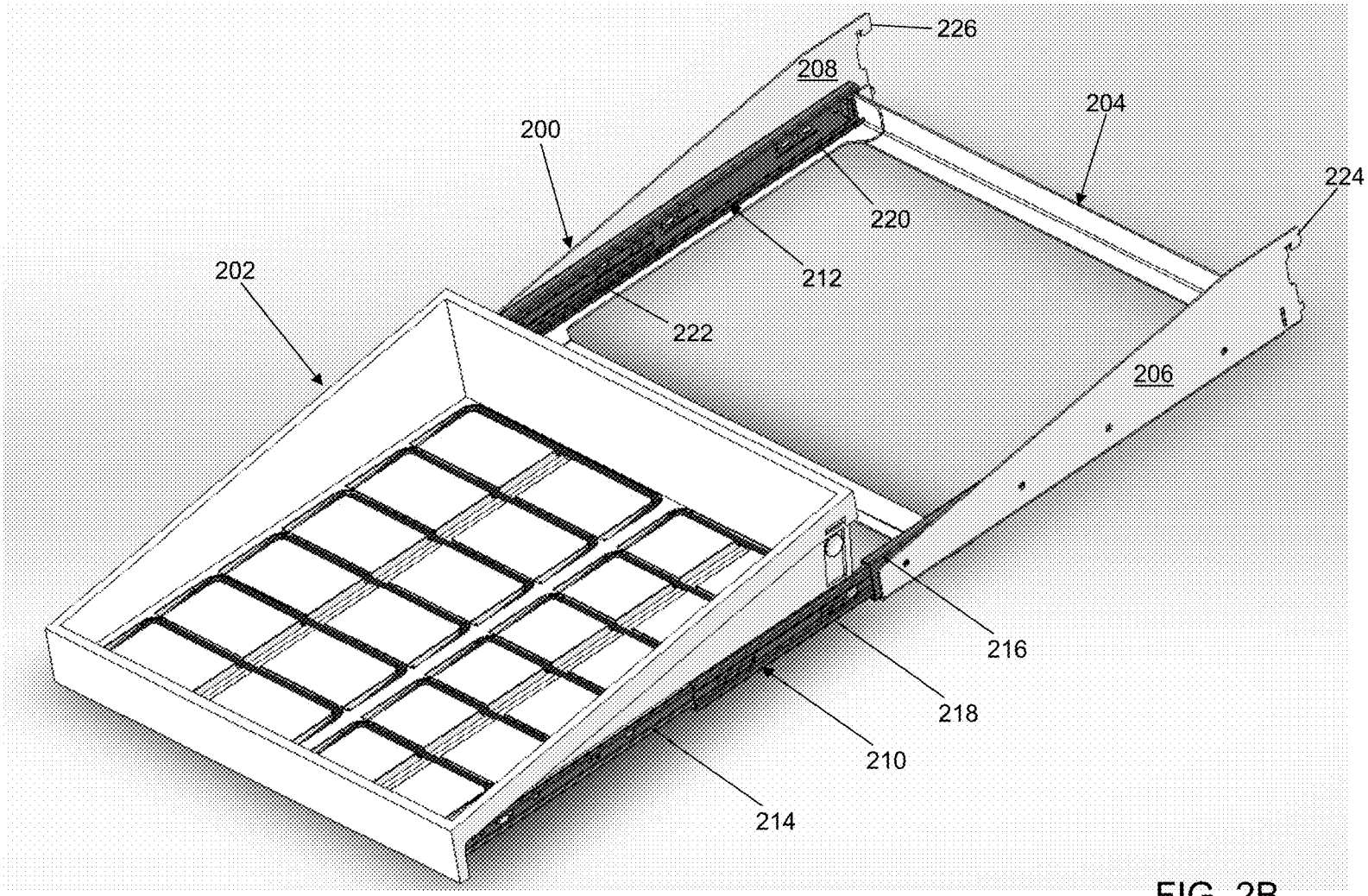
FIG. 2B depicts a front perspective view of the shelf of FIG. 2A with a tray slid out from a shelf frame of the shelf in accordance with an illustrative embodiment.

Referring to FIG. 2A, a front perspective view of a shelf 200 of the plurality of shelves 102 is shown in accordance with an illustrative embodiment. Referring to FIG. 2B, a front perspective view of shelf 200 with a tray 202 slid out from a shelf frame 204 of shelf 200 is shown in accordance with an illustrative embodiment. Shelf 200 may include tray 202, shelf frame 204, a right brace 206, a left brace 208, a right sliding tray slide 210, and a left sliding tray slide 212. A greater or a fewer number of braces may be used in alternative embodiments. For example, an additional brace may be included to support a larger tray 202. As another example, a single center brace may be used. Objects can be placed on tray 202. The components of shelf 200 may be formed of one or more materials, such as metal, glass, and/or plastic having a sufficient strength and rigidity to provide the illustrated and/or described function. For example, tray 202, a drawer, or other receptacle may be formed of one or more materials, such as metal, glass, and/or plastic having a sufficient strength and rigidity to support food objects or other objects stored in refrigerator 100 or in another interior space into which tray 202 is mounted. Another consideration for the choice of material may be an aesthetic appearance to the user of tray 202.

In the illustrative embodiment, tray 202 is mounted to right brace 206 and left brace 208 using right sliding tray slide 210 and left sliding tray slide 212 to allow tray 202 to be slid out from right brace 206 and left brace 208 and from the interior space to facilitate access to the objects placed on or in tray 202. Tray 202 may form a variety of shapes including a polygon, a circle, an ellipse, etc. of various sizes to fit within the interior space.

In the illustrative embodiment, right sliding tray slide 210 may include a right tray slide 214, a right brace slide 216, and a right glide 218. Right tray slide 214 mounts to a right side of tray 202 using various types of fasteners including adhesive, screws, rivets, pins, etc. Right brace slide 216 mounts to an inner surface of right brace 206 that faces left brace 208 using various types of fasteners including adhesive, screws, rivets, pins, soldering, etc. Right glide 218 mounts slidably to right tray slide 214 and to right brace slide 216 to allow tray 202 to slide relative to shelf frame 204.

In the illustrative embodiment, left sliding tray slide 212 may include a left tray slide (not shown), a left brace slide 220, and a left glide 222. The left tray slide mounts to a left side of tray 202 using various types of fasteners including adhesive, screws, rivets, pins, etc. Left brace slide 220 mounts to an inner surface of left brace 208 that faces right brace 206 using various types of fasteners including adhesive, screws, rivets, pins, etc. Left glide 222 mounts slidably to the left tray slide and to left brace slide 220 to allow tray 202 to slide relative to shelf frame 204. Right sliding tray slide 210 and left sliding tray slide 212 may be identical.

In alternative embodiments, other mounting mechanisms may be used to mount tray 202 within the interior space as well as to mount tray 202 to right brace 206 and/or left brace 208 and/or to shelf frame 204. In alternative embodiments, tray 202 may not be mounted to right brace 206 and/or to left brace 208 and/or right sliding tray slide 210 and left sliding tray slide 212 may not be included. In an alternative embodiment, tray 202 may be fixedly mounted to right brace 206 and left brace 208. In still another alternative embodiment, tray 202 may be mounted directly to shelf frame 204 without mounting to right brace 206 and/or left brace 208. In yet another alternative embodiment, tray 202 may rest on shelf frame 204 without mounting to right brace 206 and/or left brace 208 or attaching to shelf frame 204.

Shelf frame 204 may form a variety of shapes including a polygon, a circle, etc. of various sizes to fit within the interior space and to support tray 202. In the illustrative embodiment, shelf frame 204 includes a front brace 224, a right side brace 226, a left side brace 228, and a back brace 230 that are mounted to each other to form a rectangular aperture and/or to form a rectangular platform below tray 202 and on which tray 202 may rest in alternative embodiments. In the illustrative embodiment, front brace 224 and back brace 230 are mounted to and between right side brace 226 and left side brace 228. In the illustrative embodiment, right side brace 226 is mounted to right brace 206, for example, using various types of fasteners including adhesive, screws, rivets, pins, soldering, etc. though other mounting mechanisms may be used when shelf frame 204 is mounted to right brace 206. In the illustrative embodiment, left side brace 228 is mounted to left brace 208, for example, using various types of fasteners including adhesive, screws, rivets, pins, soldering, etc. though other mounting mechanisms may be used when shelf frame 204 is mounted to left side brace 228. Shelf frame 204 may include a plate having a variety of shapes with zero or more apertures with or without front brace 224, right side brace 226, left side brace 228, and/or back brace 230.

Right brace 206 and left brace 208 may have various shapes and dimensions and may be formed of various materials selected to be strong enough to support a weight of objects placed on tray 202. Right brace 206 may include a right bracket portion 224. Left brace 206 may include a left bracket portion 226. Left brace 208 may form a mirror image of right brace 206 relative to a vertical plane through a center of a space between right brace 206 and left brace 208. Right bracket portion 224 and left bracket portion 226 may be shaped and sized to mount to first right ladder 108 and to the first left ladder, respectively, by insertion within an opening formed in first right ladder 108 and in the first left ladder, respectively. Using various openings formed in first right ladder 108 and in the first left ladder, as understood by a person of skill in the art, a position of shelf 200 can be adjusted within the interior space or on door 106 or shelf 200 and/or tray 202 can be removed from the interior space or from door 106. In alternative embodiments, shelf 200 and/or tray 202 may not be movable within the interior space and/or may not be removable from the interior space. Though not shown, a brace need not be mounted adjacent a wall that forms the interior space. Instead, the brace may be mounted, for example, to first back wall 110 between the side walls that form the interior space as an additional support for tray 202 that extends between the side walls or to provide support for tray 202 that does not extend an entire width between the side walls.

Figure 3:
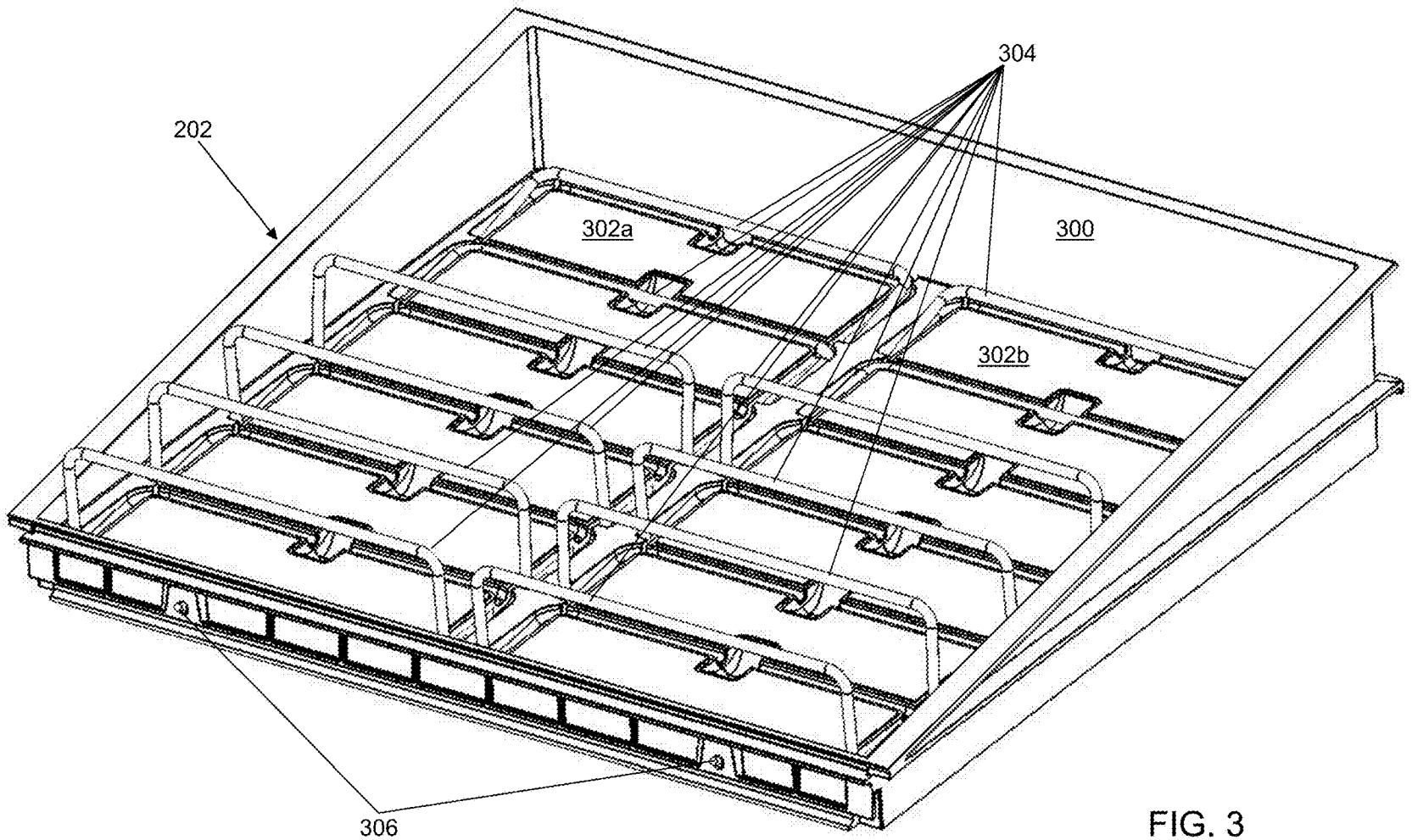
FIG. 3 depicts a front perspective view of the tray of FIG. 2B removed from the shelf in accordance with an illustrative embodiment.
Figure 4:
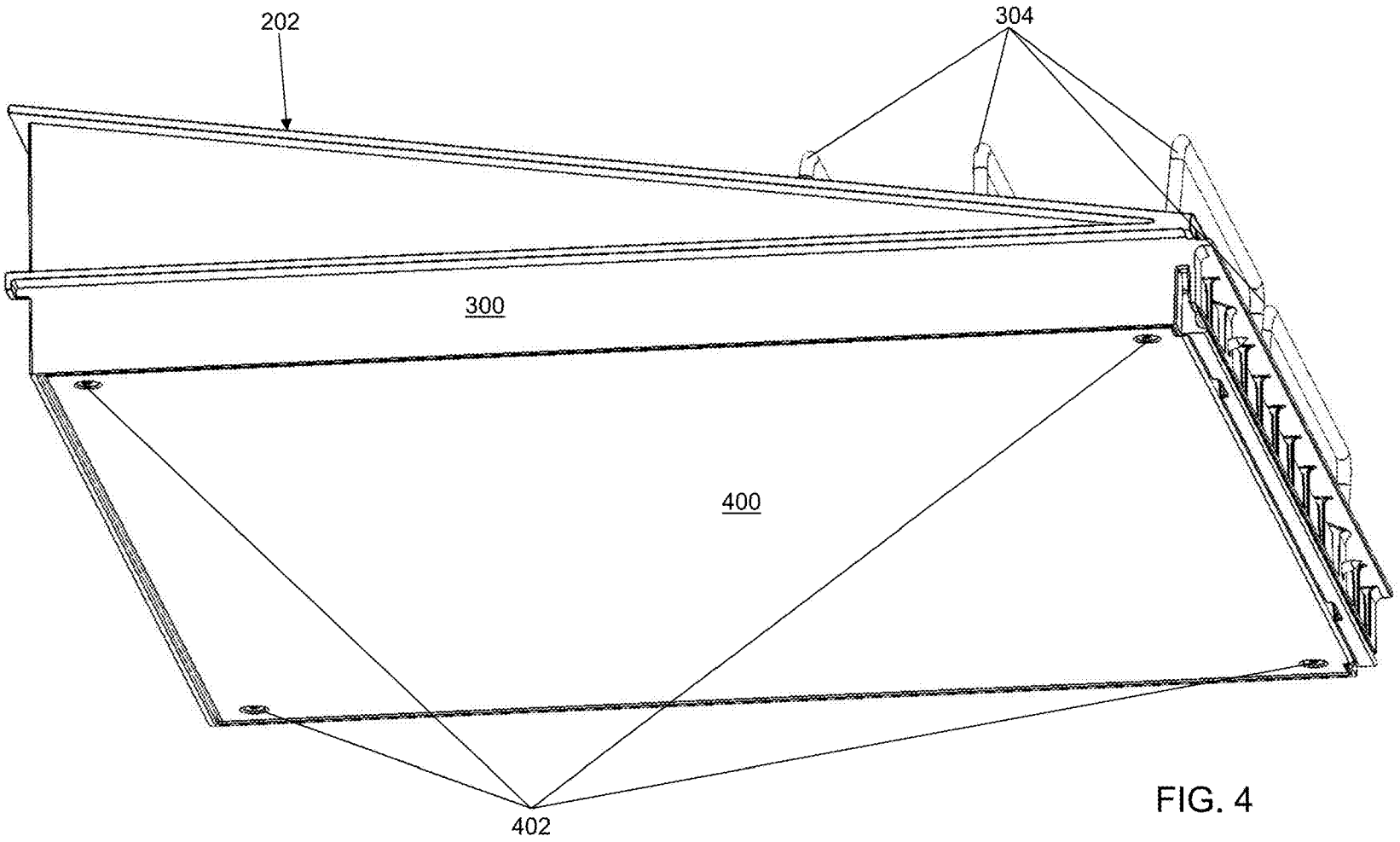
FIG. 4 depicts a bottom, left side perspective view of the tray of FIG. 3 in accordance with an illustrative embodiment.

Referring to FIG. 3, a front perspective view of tray 202 removed from shelf 200 is shown in accordance with an illustrative embodiment. Referring to FIG. 4, a bottom, left side perspective view of tray 202 is shown in accordance with an illustrative embodiment. In the illustrative embodiment, tray 202 includes a base 300, a first top plate 302*a*, a second top plate 302*b*, a plurality of support arms 304, a bottom plate 400, a first plurality of fasteners 402, and a second plurality of fasteners 306. The first plurality of fasteners 402 are inserted through a plurality of apertures 700 (shown referring to FIG. 7) formed through bottom plate 400 to mount bottom plate 400 to base 300. First top plate 302*a* and second top plate 302*b* are mounted on base top plate 1600 (shown referring to FIG. 16). For example, first top plate 302*a* and second top plate 302*b* rest on base top plate 1600 with aligned indentations as discussed further below. The plurality of support arms 304 mount to first top plate 302*a*, to second top plate 302*b*, and to base top plate 1600 as discussed further below. The second plurality of fasteners 306 may be used to mount a faceplate.

In the illustrative embodiment, a number of the plurality of support arms 304 is twelve arranged in two columns though there may a greater or a fewer number of support arms arranged in a greater or a fewer number of columns with one or more support arms in each column. Each column is associated with one of first top plate 302*a* or second top plate 302*b*. In an alternative embodiment, first top plate 302*a* and second top plate 302*b* may be joined to form a single top plate. In the illustrative embodiment, first top plate 302*a* and second top plate 302*b* extend from a front of base 300 to a back of base 300 though in alternative embodiments, first top plate 302*a* and second top plate 302*b* may extend from a right side of base 300 to a left side of base 300 or in other directions within base 300 to form a greater or a fewer number of rows or columns. In alternative embodiments, the plurality of support arms 304 may not be aligned from front to back or from left to right or vice versa. The plurality of support arms 304 may be offset from each other to form various arrangements, for example, based on an expected size of objects stored in or on tray 202.

Each support arm 1200 (shown referring to FIG. 12) of the plurality of support arms 304 may be independently rotated toward or away from first top plate 302*a* and/or second top plate 302*b* between a first stop position when support arm 1200 is in a fully lowered rotated position and a second stop position when support arm 1200 is in a fully upright rotated position. The first stop position may define a locked position in first top plate 302*a* and/or second top plate 302*b*. The second stop position may define a maximum angle of rotation from the first stop position. For illustration, the maximum angle may be between 85 and 95 degrees from the first stop position. Support arm 1200 may remain upright at an approximately 85 degree angle of rotation from the first stop position with an automatic spring adjustment between 85 and 95 degrees to hold objects upright such as cans, bottles, jars, etc.

Figure 5:
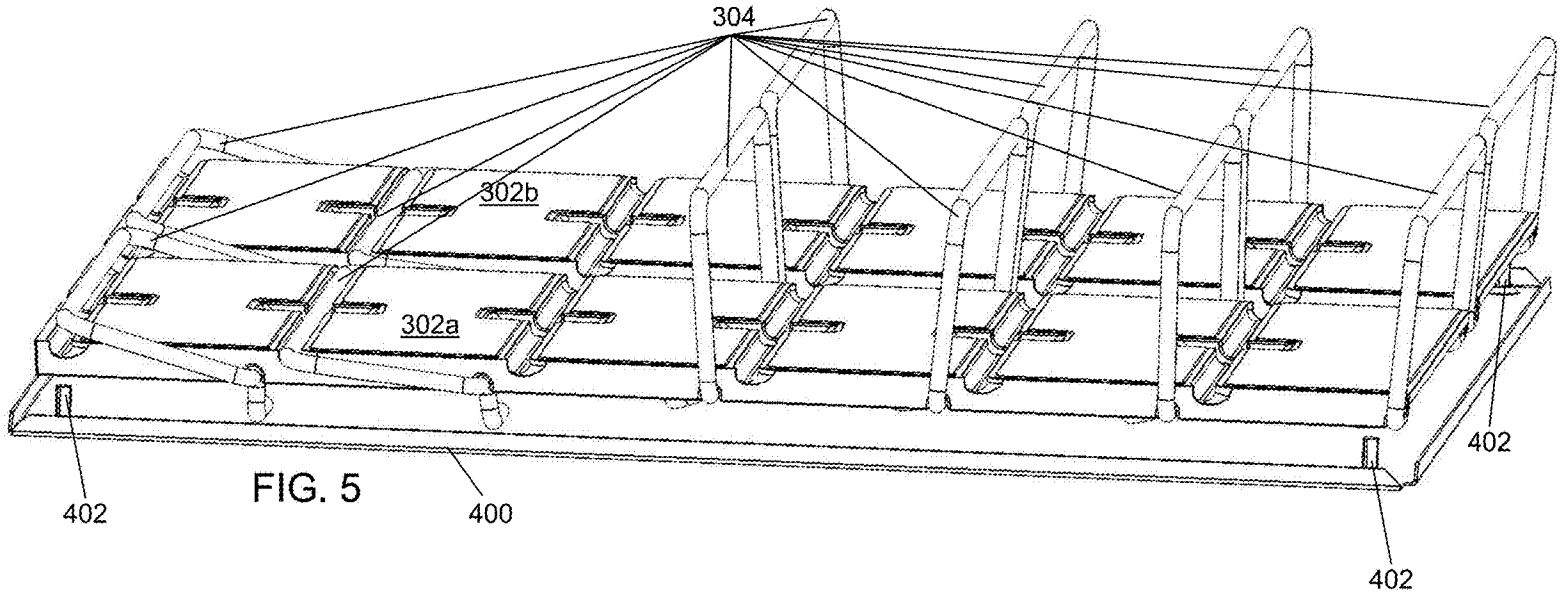
FIG. 5 depicts a top, left side perspective view of the tray of FIG. 3 without a base in accordance with an illustrative embodiment.
Figure 6:
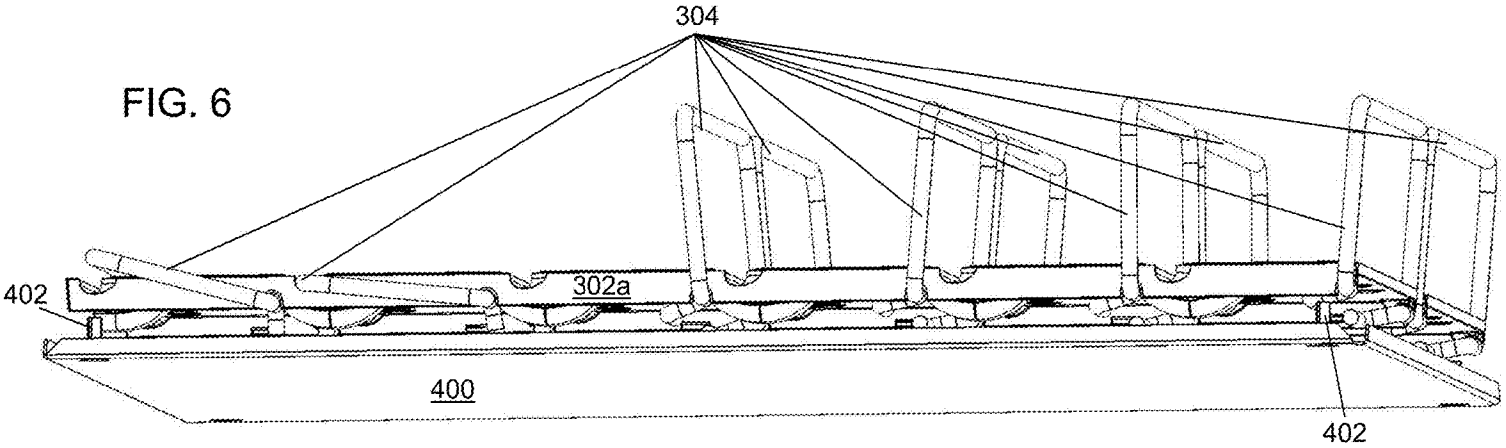
FIG. 6 depicts a left side perspective view of the tray of FIG. 3 without the base in accordance with an illustrative embodiment.

Referring to FIG. 5, a top, left side perspective view of tray 202 is shown without base 300 in accordance with an illustrative embodiment. Referring to FIG. 6, a left side perspective view of tray 202 is shown without base 300 in accordance with an illustrative embodiment. The first plurality of fasteners 402 and base 300 define a space between base top plate 1600 and bottom plate 400 within which a right hook 1202 (shown referring to FIG. 12) and a left hook 1204 (shown referring to FIG. 12) can rotate as support arm 1200 is rotated from the first stop position to the second stop position.

Figure 7:
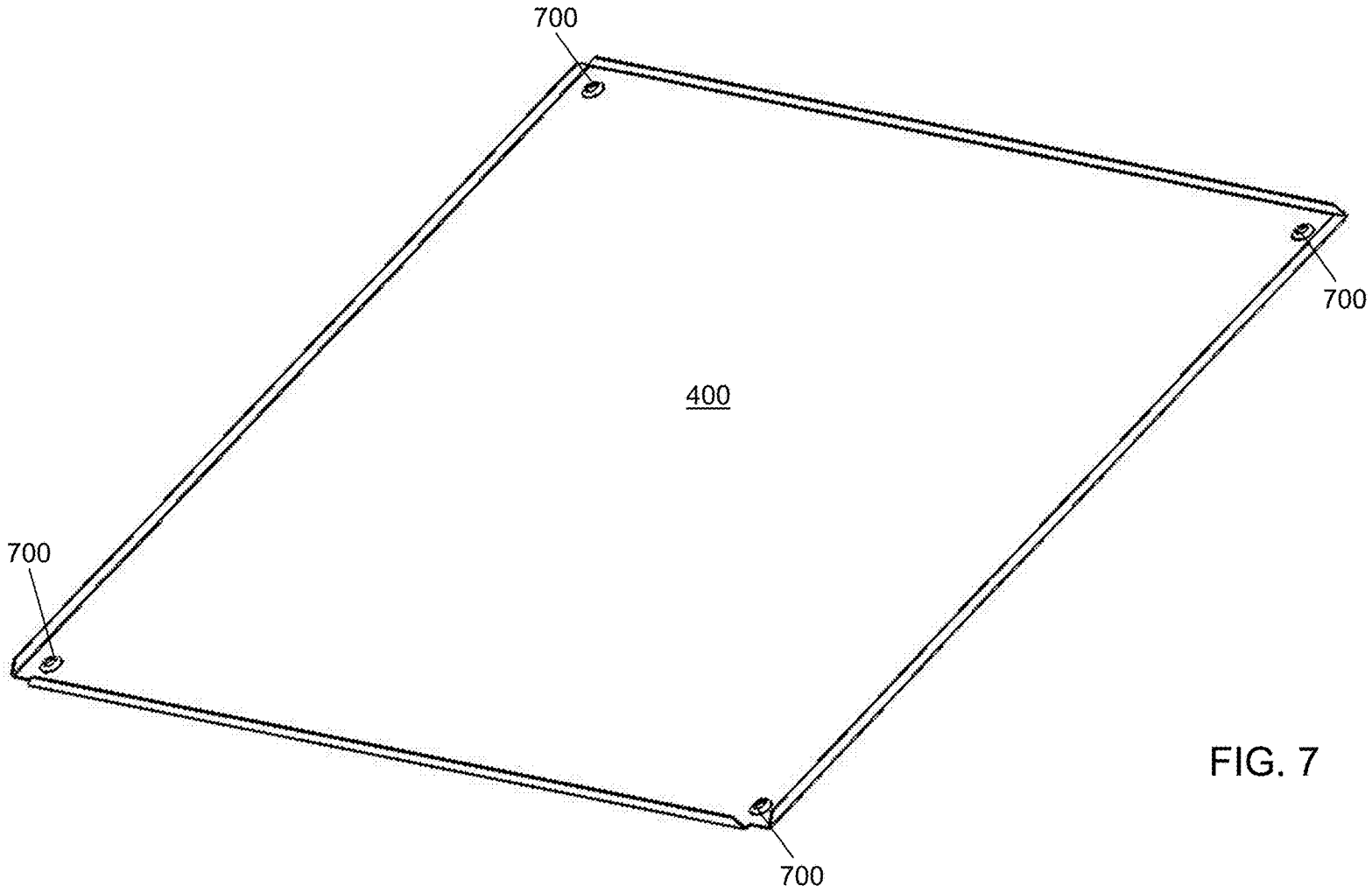
FIG. 7 depicts a back left side perspective view of a bottom plate of the tray of FIG. 3 in accordance with an illustrative embodiment.

Referring to FIG. 7, a back left side perspective view of bottom plate 400 of tray 202 is shown in accordance with an illustrative embodiment. Bottom plate 400 covers a surface below base top plate 1600 between sidewalls of base 300 though bottom plate 400 is not required. In the illustrative embodiment, an aperture of the plurality of apertures 700 is formed adjacent each corner of bottom plate 400 though a fewer or a greater number of apertures may be used at various locations on bottom plate 400 in alternative embodiments. A fastener of the first plurality of fasteners 402 is inserted into each aperture of the plurality of apertures 700 and into a protrusion of a plurality of protrusions 1700 (shown referring to FIG. 17) formed from a bottom surface of base top plate 1600 to mount bottom plate 400 to base 300 though other mounting mechanisms may be used. In the illustrative embodiment, a periphery of bottom plate 400 has upturned edges that extend towards base top plate 1600 when bottom plate 400 is mounted to base 300 though this is not required. Bottom plate 400 may be formed of one or more materials, such as metal, glass, and/or plastic having a sufficient strength and rigidity to support food objects or other objects stored, for example, in refrigerator 100. For example, bottom plate 400 may be formed of a single piece of material such as plastic using a molding process.

Figure 8:
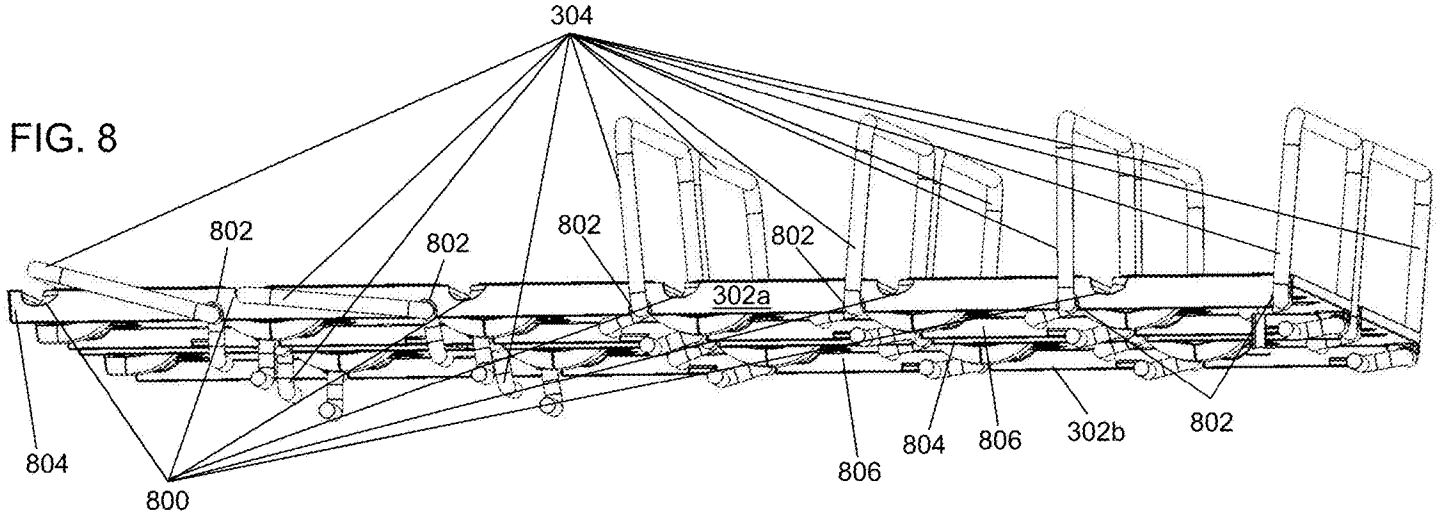
FIG. 8 depicts a left side perspective view of the tray of FIG. 3 without the base or the bottom plate of FIG. 7 in accordance with an illustrative embodiment.
Figure 9:
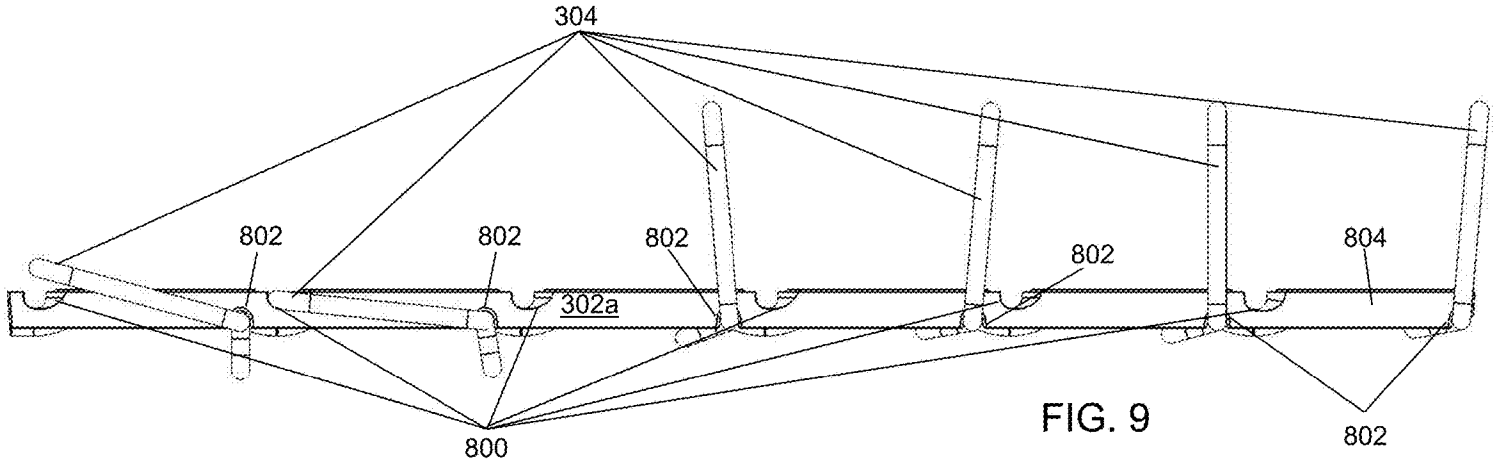
FIG. 9 depicts a left side view of the tray of FIG. 3 without the base or the bottom plate of FIG. 7 in accordance with an illustrative embodiment.
Figure 10:
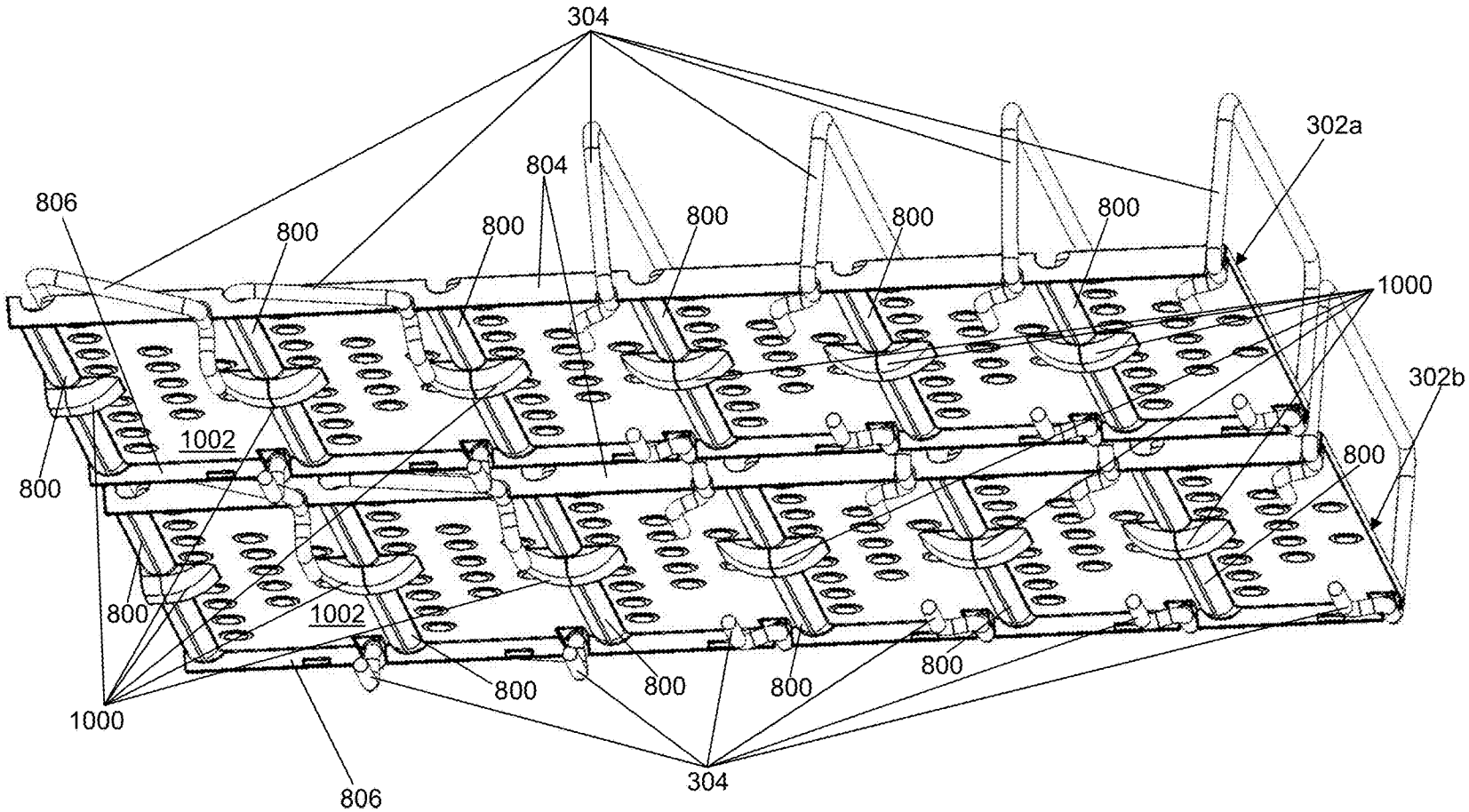
FIG. 10 depicts a bottom left side perspective view of the tray of FIG. 3 without the base or the bottom plate of FIG. 7 in accordance with an illustrative embodiment.
Figure 11:
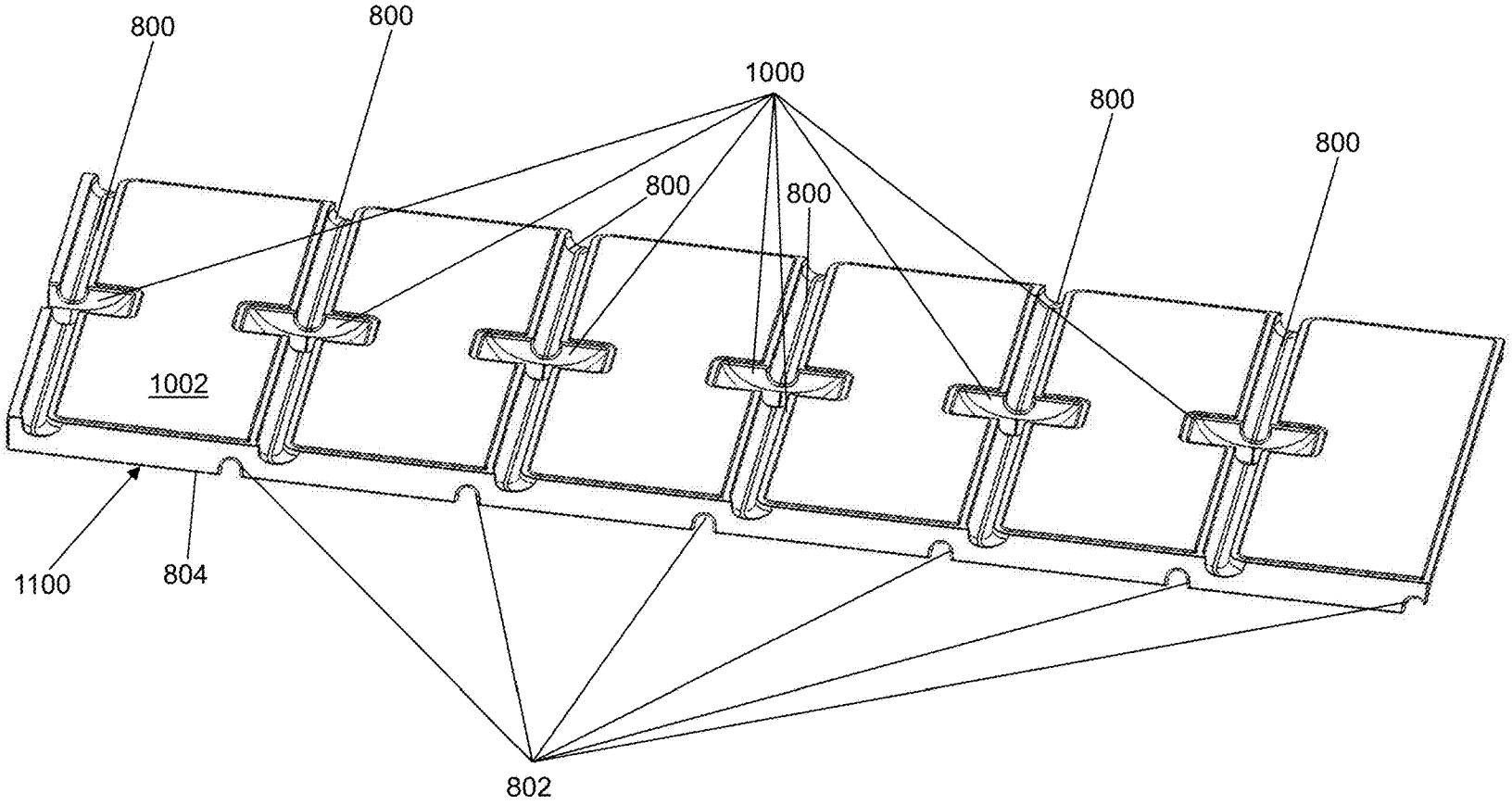
FIG. 11 depicts a left side perspective view of a top plate of the tray of FIG. 3 in accordance with an illustrative embodiment.

Referring to FIG. 8, a left side perspective view of tray 202 is shown without base 300 or bottom plate 400 in accordance with an illustrative embodiment. Referring to FIG. 9, a left side view of tray 202 is shown without base 300 or bottom plate 400 in accordance with an illustrative embodiment. Referring to FIG. 10, a bottom left side perspective view of tray 202 is shown without base 300 or bottom plate 400 in accordance with an illustrative embodiment. Referring to FIG. 11, a left side perspective view of a top plate 1100 of tray 202 is shown in accordance with an illustrative embodiment. First top plate 302*a* and second top plate 302*b* are both examples of top plate 1100. Tray 202 may include one or more top plates 1100 arranged to extend in various directions relative to each other on base top plate 1600. For example, in alternative embodiments, tray 202 may include three or more top plates 1100 arranged similarly or differently.

In the illustrative embodiment, first top plate 302*a* and second top plate 302*b* are identical with first top plate 302*a* mounted on base top plate 1600 to the left of second top plate 302*b* and with six support arms of the plurality of support arms 304 mounted to each of first top plate 302*a* and second top plate 302*b* such that a pair of support arms are aligned from left to right across first top plate 302*a* and second top plate 302*b*. In alternative embodiments, first top plate 302*a* and second top plate 302*b* may not be identical and may include a different number of arms relative to each other. In alternative embodiments, the support arms may not be aligned. For example, first top plate 302*a* may include six arms that extend from top to bottom on base top plate 1600 while second top plate 302*b* may include three arms that extend from left to right or vice versa on base top plate 1600.

Top plate 1100 may include a top wall 1002, a left sidewall 804, and a right sidewall 806 though in alternative embodiments, left sidewall 804, and right sidewall 806 may be formed as top and/or bottom sidewalls. For example, though in the illustrative embodiment, each support arm 1200 extends linearly, in an alternative embodiment, support arm 1200 may be curved and extend between right sidewall 806 and a top sidewall (not shown) or a bottom sidewall (not shown) and/or between left sidewall 804 and the top sidewall or the bottom sidewall. Top plate 1100 may be formed of one or more materials, such as metal, glass, and/or plastic having a sufficient strength and rigidity to support food objects or other objects stored in refrigerator 100. For example, top plate 1100 may be formed of a single piece of material such as plastic using a molding process.

First top plate 302*a* and second top plate 302*b* each include a support arm stop trough 800, a support arm fulcrum aperture 802, and a finger channel 1000 for each support of the plurality of support arms 304 mounted to each of first top plate 302*a* and second top plate 302*b*. Support arm stop trough 800 and finger channel 1000 are depressions formed in top wall 1002. Support arm stop trough 800 is sized and shaped such that a top arm portion 1206 (shown referring to FIG. 12) of support arm 1200 fits therein. For example, top arm portion 1206 may snap fit within support arm stop trough 800 when support arm 1200 is in the first stop position and may form a generally level surface with top wall 1002 when support arm 1200 is in the first stop position to avoid tipping objects placed on top wall 1002 when support arm 1200 is not used.

Finger channel 1000 is sized and shaped such that a user's finger can fit therein to allow grasping of top arm portion 1206 to lift top arm portion 1206 away from base top plate 1600 such that a right fulcrum portion 1208 (shown referring to FIG. 12) of support arm 1200 and a left fulcrum portion 1210 (shown referring to FIG. 12) of support arm 1200 rotate within support arm fulcrum aperture 802 formed in right sidewall 806 and in left sidewall 804, respectively. In the illustrative embodiment, support arm fulcrum aperture 802 forms an arc shape in right sidewall 806 and in left sidewall 804 open away from top wall 1002 though support arm fulcrum aperture 802 may form other shapes. For example, support arm fulcrum aperture 802 forms the arc shape because right fulcrum portion 1208 and left fulcrum portion 1210 have a circular cross section to facilitate rotation of support 1200 within support arm fulcrum aperture 802 though this is not required.

Support arm stop trough 800 and support arm fulcrum aperture 802 are positioned relative to each other based on an orientation of and dimensions of support arm 1200. In the illustrative embodiment, finger channel 1000 is centered between right sidewall 806 and left sidewall 804 and extends from a top and a bottom of support arm stop trough 800 so that the user's finger can grab top arm portion 1206 with a similar force on support arm fulcrum aperture 802 formed in right sidewall 806 and in left sidewall 804. Finger channel 1000 can be placed anywhere between right sidewall 806 and left sidewall 804 or the sidewalls in which support arm fulcrum aperture 802 is formed in alternative embodiments.

Figure 13:
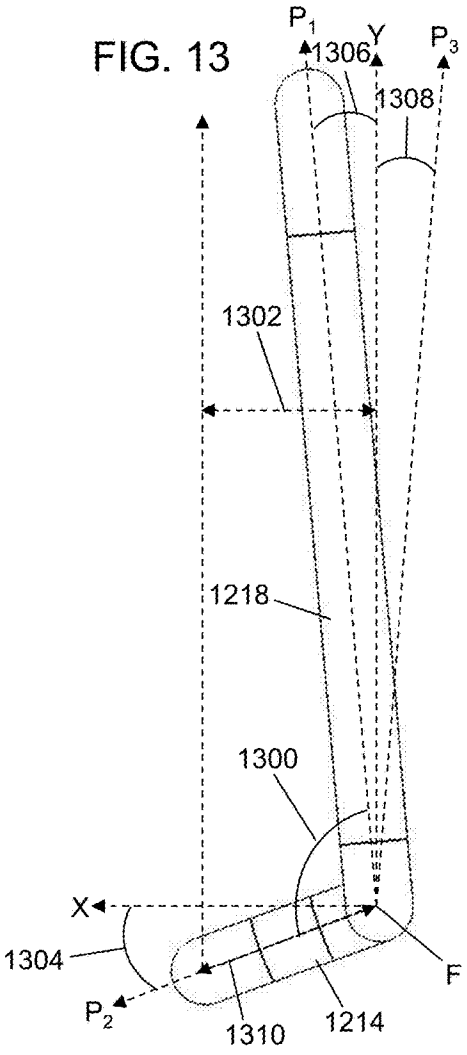
FIG. 13 depicts a left side view of the support arm of FIG. 12 in accordance with an illustrative embodiment.
Figure 12:
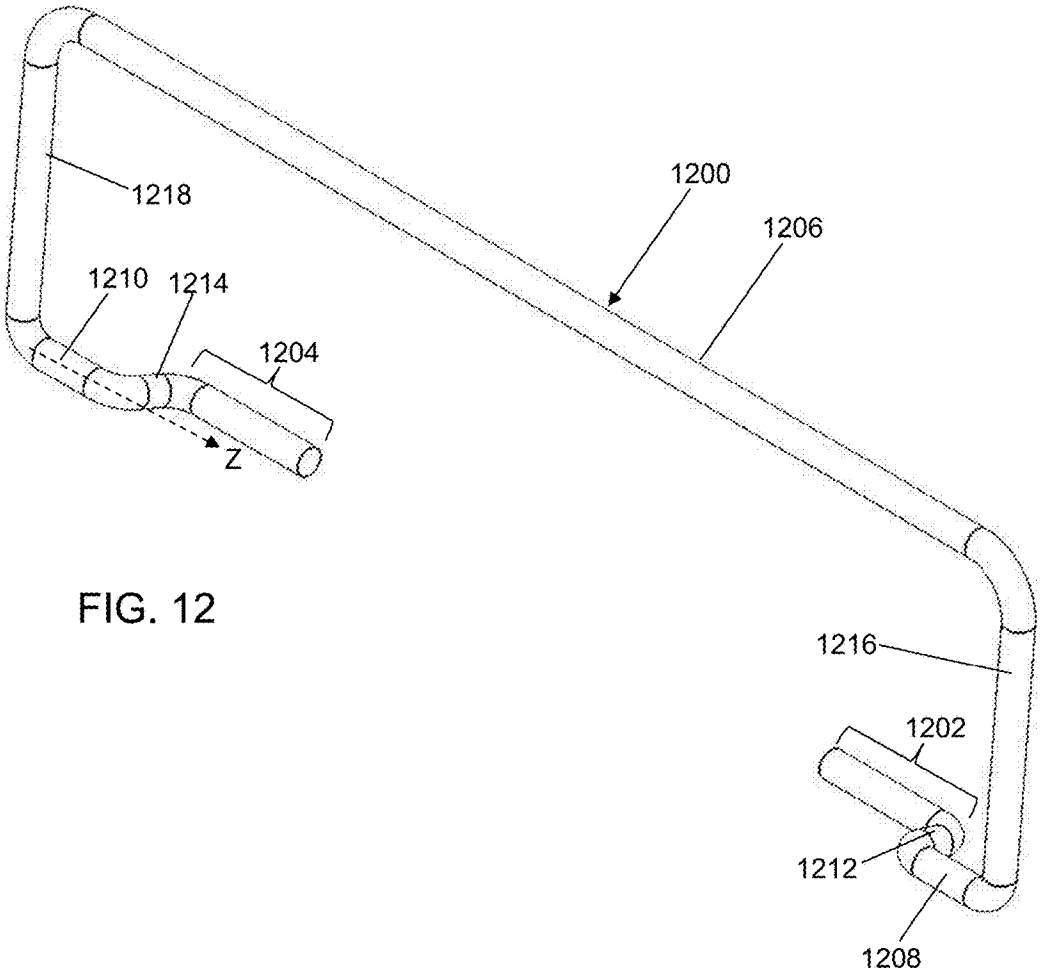
FIG. 12 depicts a front perspective view of a support arm of the tray of FIG. 3 in accordance with an illustrative embodiment.
Figure 14:
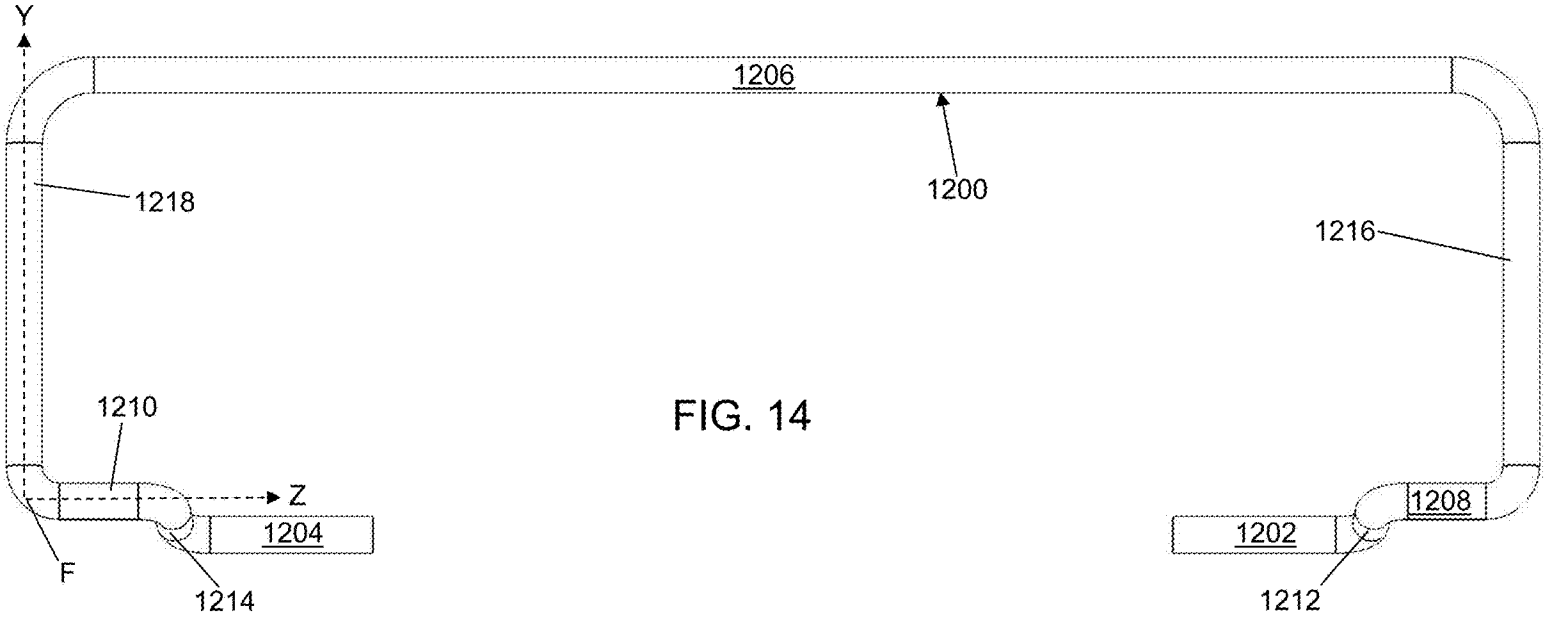
FIG. 14 depicts a front view of the support arm of FIG. 12 in accordance with an illustrative embodiment.
Figure 15:
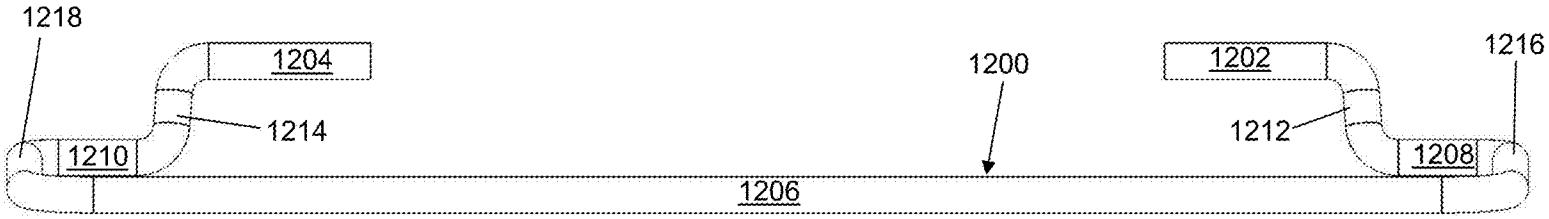
FIG. 15 depicts a top view of the support arm of FIG. 12 in accordance with an illustrative embodiment.

Referring to FIG. 12, a front perspective view of support arm 1200 of tray 202 is shown in accordance with an illustrative embodiment. Referring to FIG. 13, a left side view of support arm 1200 is shown in accordance with an illustrative embodiment. Referring to FIG. 14, a front view of the support arm 1200 is shown in accordance with an illustrative embodiment. Referring to FIG. 15, a top view of support arm 1200 is shown in accordance with an illustrative embodiment.

In the illustrative embodiment, each support arm 1200 of the plurality of support arms 304 may include right hook 1202, left hook 1204, top arm portion 1206, right fulcrum portion 1208, left fulcrum portion 1210, a right hook transition portion 1212, a left hook transition portion 1214, a right side portion 1216, and a left side portion 1218. Right hook 1202, left hook 1204, top arm portion 1206, right fulcrum portion 1208, left fulcrum portion 1210, right hook transition portion 1212, left hook transition portion 1214, right side portion 1216, and left side portion 1218 are formed of a single continuous material with a circular cross section though other shaped cross sections may be used such as elliptical or polygonal. For example, support arm 1200 may be formed of a bent wire formed of a metal material that may be all or partially covered in a coating material such as a rubber or a plastic material though other materials may be used. For example, instead of coated metal, support arm 1200 may be formed of a plastic material. In an alternative embodiment, right hook 1202, left hook 1204, top arm portion 1206, right fulcrum portion 1208, left fulcrum portion 1210, right hook transition portion 1212, left hook transition portion 1214, right side portion 1216, and left side portion 1218 may be formed of one or more materials mounted to each other, for example, using one or more fasteners such as adhesive, soldering, a screw, a rivet, etc.

Right hook 1202, left hook 1204, top arm portion 1206, right fulcrum portion 1208, left fulcrum portion 1210 may be parallel to each other and generally extend parallel to a z-axis shown referring to FIG. 12 that is perpendicular to an x-axis and a y-axis shown referring to FIG. 13. The x-axis, y-axis, and z-axis form a right-hand coordinate reference frame. In the illustrative embodiment, top arm portion 1206, right fulcrum portion 1208, left fulcrum portion 1210, right side portion 1216, and left side portion 1218 are approximately centered in the y-z plane as shown referring to FIG. 15. Right side portion 1216 and left side portion 1218 are approximately perpendicular to top arm portion 1206, right fulcrum portion 1208, and left fulcrum portion 1210 with curved transition portions between top arm portion 1206 and right side portion 1216, between right side portion 1216 and right fulcrum portion 1208, between top arm portion 1206 and left side portion 1218, and between left side portion 1218 and left fulcrum portion 1210.

A vector $P_1$ is defined to extend through a center of left side portion 1218. A vector $P_2$ is defined to extend through a center of left hook transition portion 1214. An angle 1300 is formed between left hook transition portion 1214 and left side portion 1218 in the x-y plane. Angle 1300 is also formed between right hook transition portion 1212 and right side portion 1216. A center of right hook 1202 and left hook 1204 are offset a distance 1302 from the y-z plane based on a length 1310 of right hook transition portion 1212 and of left hook transition portion 1214 and an angle 1304 defined between vector $P_2$ and the x-axis. Support arm 1200 rotates about the z-axis centered through a point F defined through a center of right fulcrum portion 1208 and of left fulcrum portion 1210 relative to the z-axis.

In an illustrative embodiment, support arm 1200 may be held upright relative to base top plate 1600 using a right spring 1602 (shown referring to FIG. 16) and a left spring 1604 (shown referring to FIG. 16) defined for each support arm 1200. There may be a fewer or a greater number of springs associated with each support arm 1200 position on base top plate 1600 in alternative embodiments. A first upright angle 1306 is defined between vector $P_1$ and the y-axis that may be a vertical axis relative to base top plate 1600. A second upright angle 1308 is defined between a vector $P_3$, which defines the second stop position, and the y-axis. Right spring 1602 and left spring 1604 may be configured to hold support arm 1200 upright between vector $P_1$ and vector $P_3$. Merely for illustration, angle 1300 may be ~100 degrees, distance 1302 may be ~0.51 inches, angle 1304 may be ~15 degrees, first upright angle 1306 may be ~5 degrees, second upright angle 1308 may be ~5 degrees, and length 1310 may be ~0.53 inches. In alternative embodiment, angle 1300 may be adjusted which also adjusts first upright angle 1306 and second upright angle 1308. For example, if first upright angle 1306 were ~10 degrees and second upright angle 1308 were ~10 degrees angle 1300 may be 95 degrees. As another example, if first upright angle 1306 were ~15 degrees and second upright angle 1308 were ~15 degrees angle 1300 may be 90 degrees.

Though in the illustrative embodiment, right side portion 1216 and left side portion 1218 are approximately perpendicular to top arm portion 1206, in alternative embodiments, top arm portion 1206 may be curved between right side portion 1216 and left side portion 1218. Support arm 1200 may have various dimensions based on the types of objects that support arm 1200 is configured to hold. For example, a length of right side portion 1216 and left side portion 1218 may be selected to hold various sized objects that may have various shapes between adjacent support arms 1200 or between support arm 1200 and a wall of base 300 as well as to provide a sufficient height to hold the objects upright when support arm is rotated to be approximately upright. Again, in the illustrative embodiment, top arm portion 1206 fits within support arm stop trough 800, and right fulcrum portion 1208 and left fulcrum portion 1210 fit within support arm fulcrum aperture 802 formed in right sidewall 806 and left sidewall 804, respectively, when support arm 1200 is in the first stop position and mounted to top plate 1100 and to base 300.

Figure 16A:
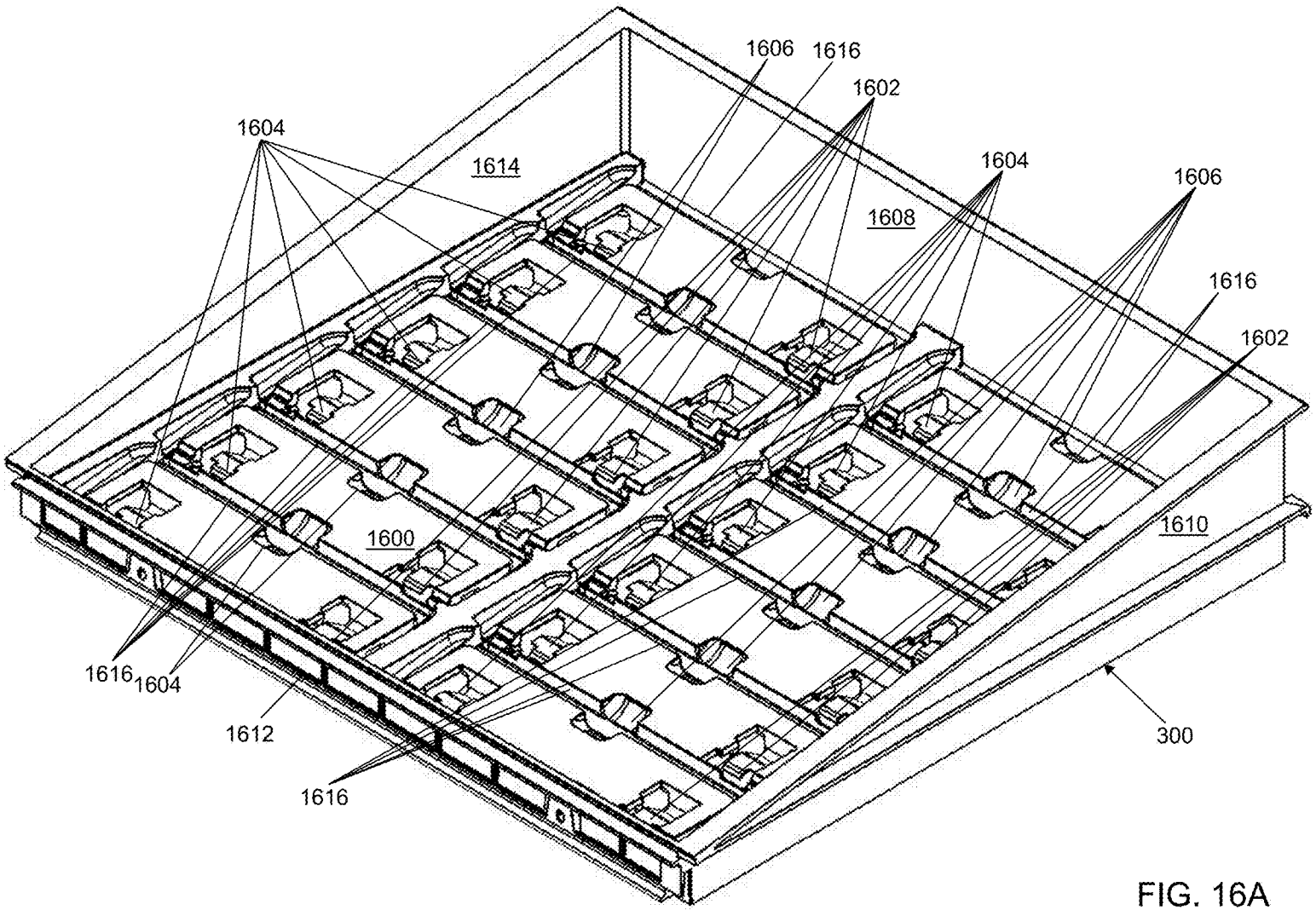
FIG. 16A depicts a front perspective view of the base of the tray of FIG. 3 in accordance with an illustrative embodiment.
Figure 16B:
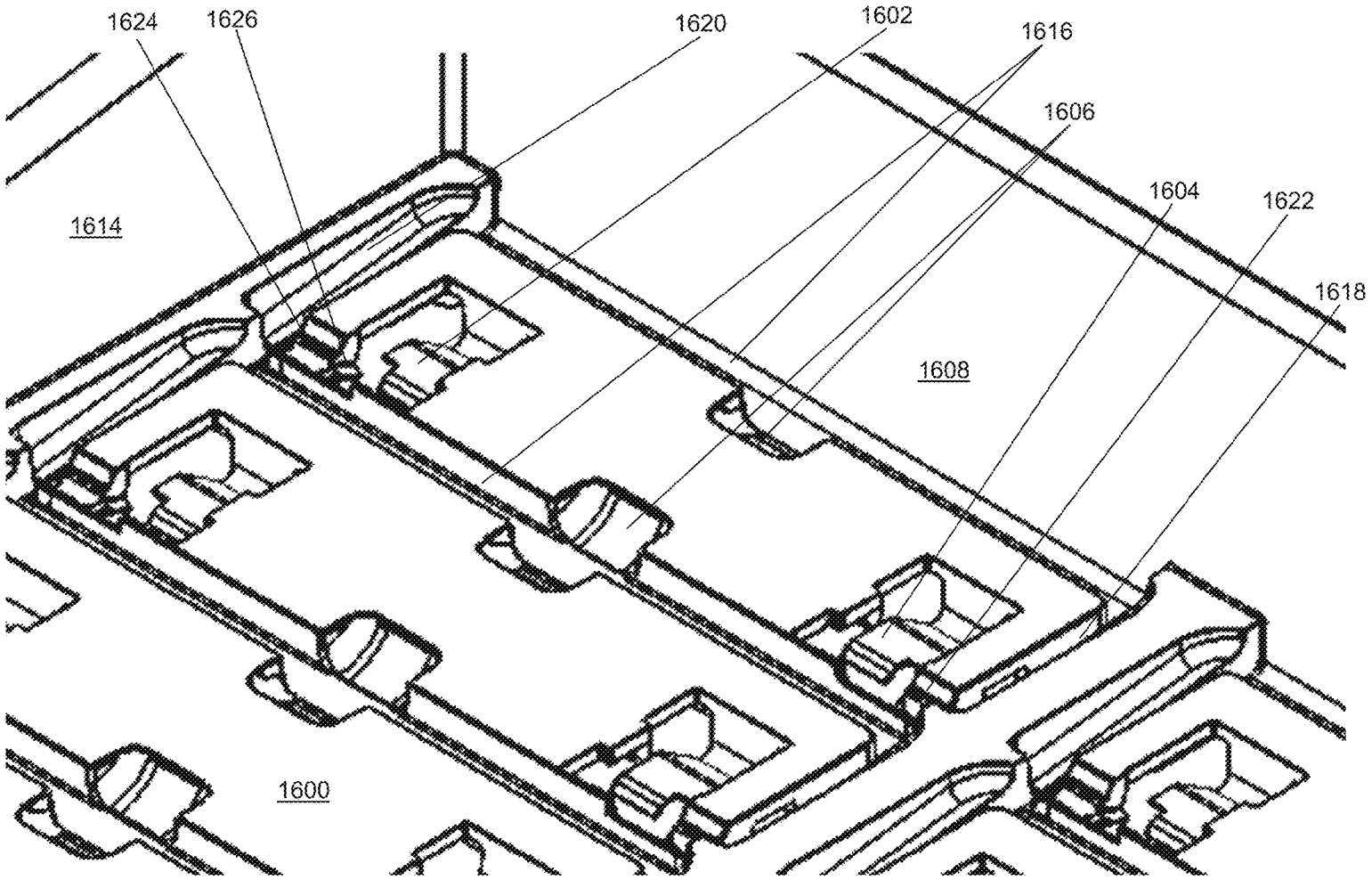
FIG. 16B depicts a zoomed front perspective view of the base of the tray of FIG. 3 in accordance with an illustrative embodiment.
Figure 17:
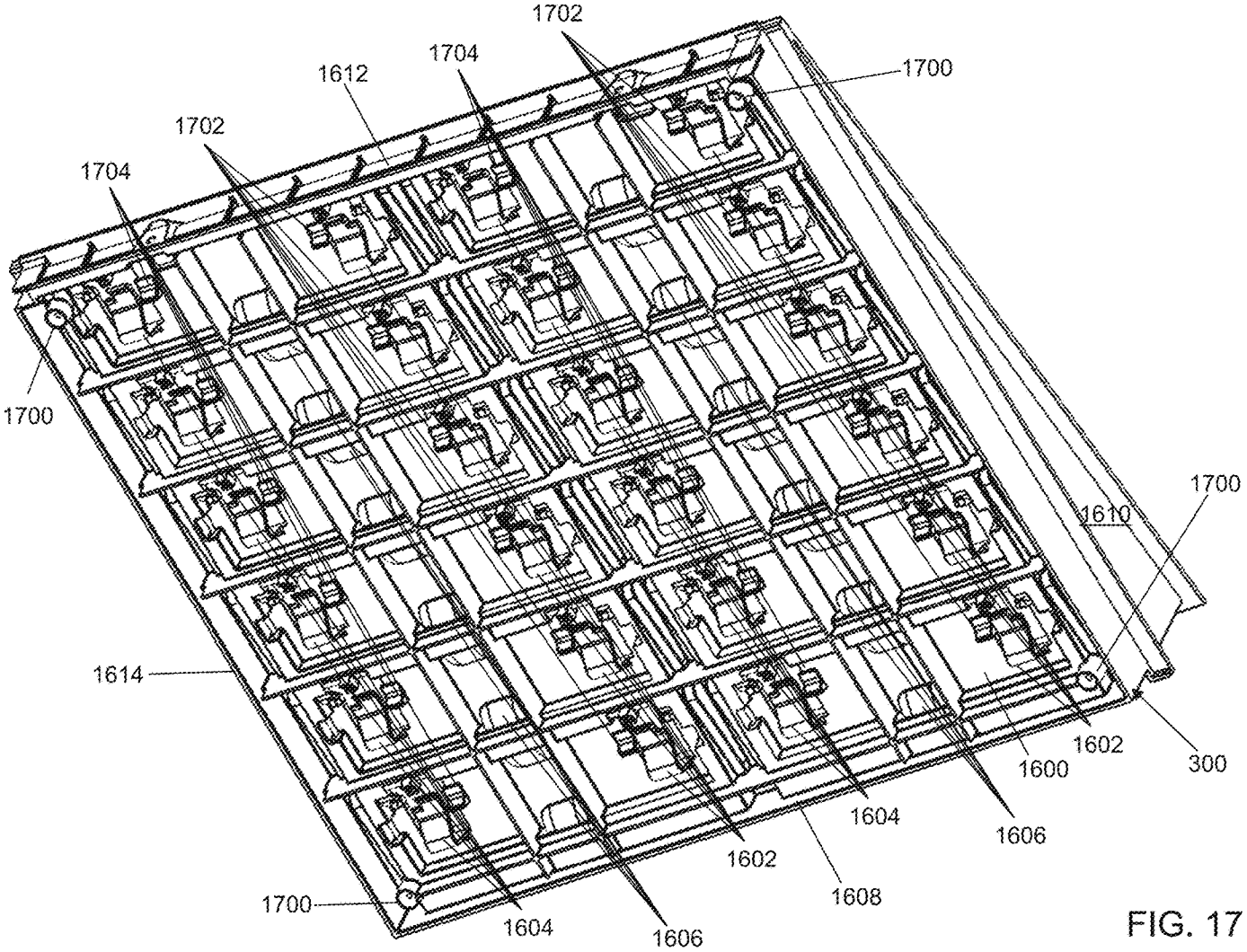
FIG. 17 depicts a bottom perspective view of the base of FIG. 16 in accordance with an illustrative embodiment.
Figure 18:
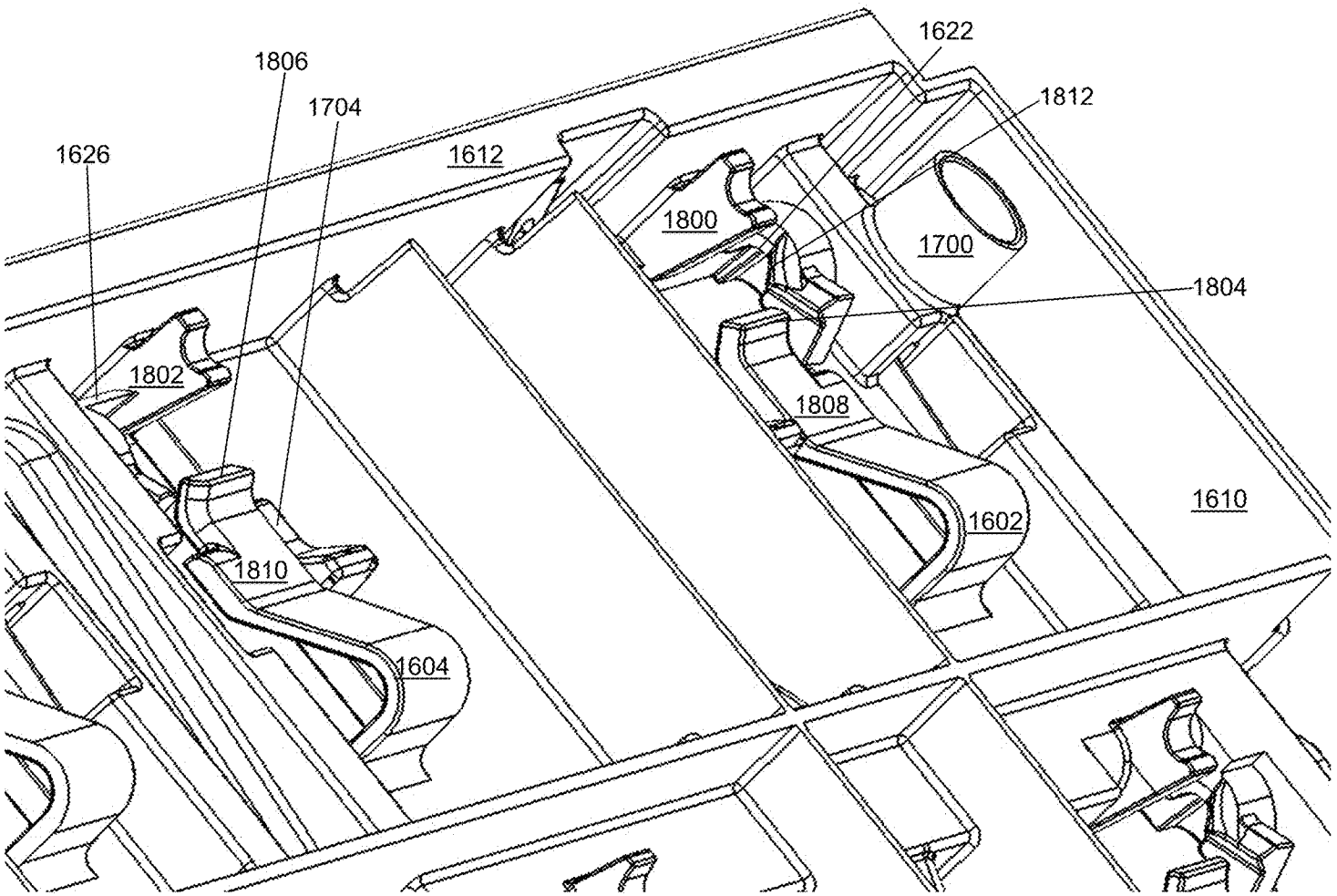
FIG. 18 depicts a first zoomed bottom perspective view of the base of FIG. 16 in accordance with an illustrative embodiment.
Figure 19:
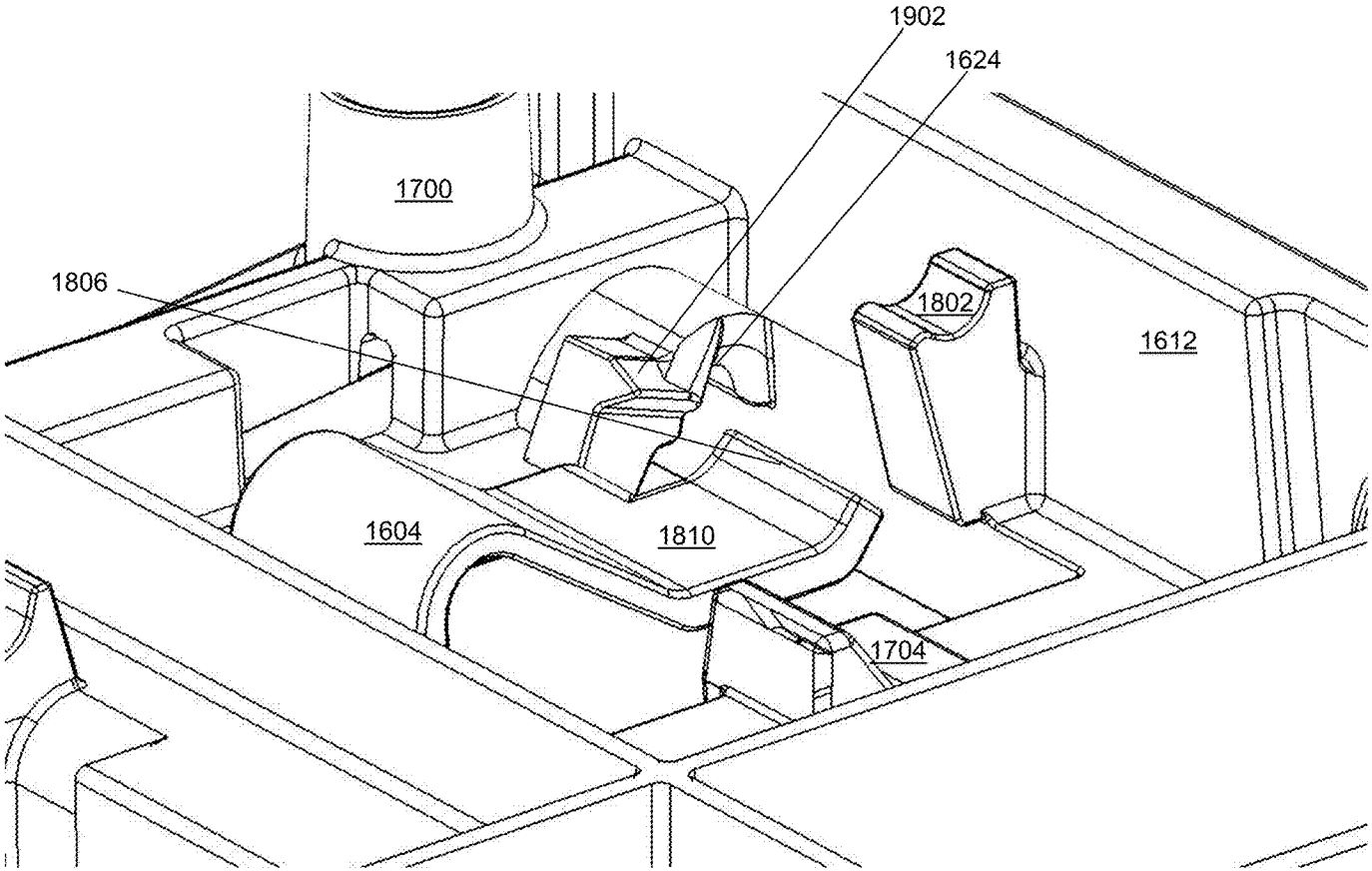
FIG. 19 depicts a second zoomed bottom perspective view of the base of FIG. 16 in accordance with an illustrative embodiment.
Figure 20:
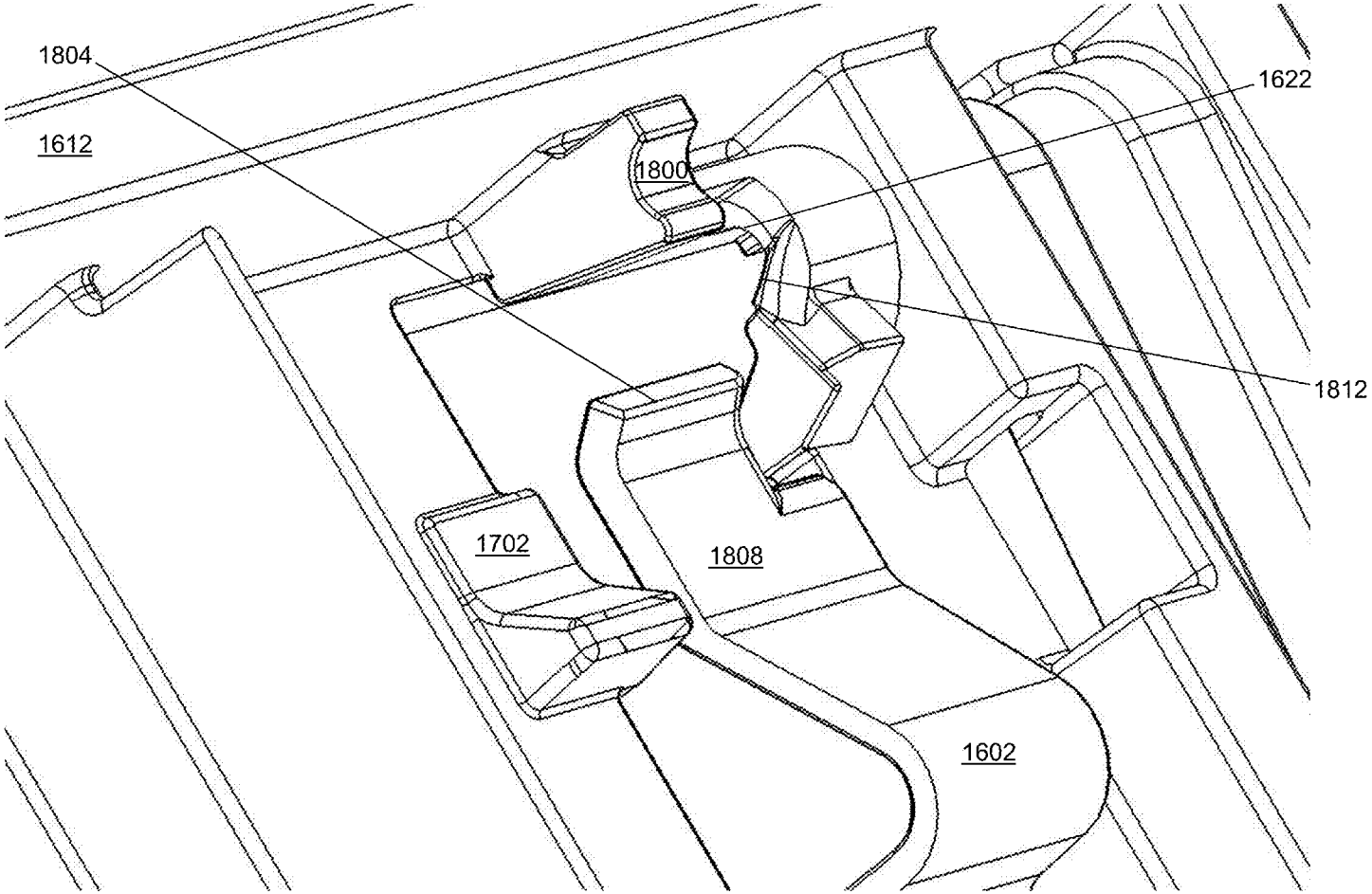
FIG. 20 depicts a third zoomed bottom perspective view of the base of FIG. 16 in accordance with an illustrative embodiment.

Referring to FIG. 16A, a front perspective view of base 300 of tray 202 is shown in accordance with an illustrative embodiment. Referring to FIG. 16B, a zoomed front perspective view of base 300 of tray 202 is shown in accordance with an illustrative embodiment. Referring to FIG. 17, a bottom perspective view of base 300 is shown in accordance with an illustrative embodiment. Referring to FIG. 18, a first zoomed bottom perspective view of base 300 is shown in accordance with an illustrative embodiment. Referring to FIG. 19, a second zoomed bottom perspective view of base 300 is shown in accordance with an illustrative embodiment. Referring to FIG. 20, a third zoomed bottom perspective view of base 300 is shown in accordance with an illustrative embodiment.

Base 300 may include base top plate 1600, a base back wall 1608, a base right side wall 1610, a base front wall 1612, and a base left side wall 1614. In the illustrative embodiments, base top plate 1600 has a polygonal shape in a horizontal plane though in alternative embodiments, base top plate 1600 may have other shapes such as circular, elliptical, etc. Base back wall 1608 extends in a generally perpendicular direction upward from a back edge of base top plate 1600. Base right side wall 1610 extends in a generally perpendicular direction upward from a right edge of base top plate 1600. Base front wall 1612 extends in a generally perpendicular direction upward from a front edge of base top plate 1600. Base left side wall 1614 extends in a generally perpendicular direction upward from a left edge of base top plate 1600. Base top plate 1600, base back wall 1608, right side wall 1610, base front wall 1612, and base left side wall 1614 define a generally enclosed space though open on top. Base 300 may be formed of one or more materials, such as metal, glass, and/or plastic having a sufficient strength and rigidity to support food objects or other objects stored in or on tray 202. For example, base 300 may be formed of a single piece of material such as plastic using a molding process.

In the illustrative embodiment, base back wall 1608 and base front wall 1612 have straight sides to form rectangles though base front wall 1612 has a smaller height to facilitate access by the user to objects placed on base top plate 1600. In the illustrative embodiment, top edges of base right side wall 1610 and base left side wall 1614 slope downwards from base back wall 1608 to base front wall 1612 though this is not required. In an alternative embodiment, base 300 need not include one or more of base back wall 1608, base right side wall 1610, base front wall 1612, and base left side wall 1614.

Base top plate 1600 has similar indentations to the one or more top plates 1100 that are mounted to base top plate 1600 based on the number of support arms of the plurality of support arms 304 included on tray 202. For example, base top plate may include base top arm trough 1616 and a base finger channel 1606 for each support arm 1200 included on tray 202. Each finger channel 1000 aligns with and is positioned within an associated base finger channel 1606. Each support arm stop trough 800 aligns with and is positioned within an associated base top arm trough 1616.

Base top plate 1600 may further include a right arm trough 1618, a left arm trough 1620, a right fulcrum platform 1622, a left fulcrum platform 1624, a right sloped platform 1812 (shown referring to FIG. 18), a left sloped platform 1626, a first right stop platform 1800 (shown referring to FIG. 18), a first left stop platform 1802 (shown referring to FIG. 18), a second right stop platform 1702 (shown referring to FIG. 17), and a second left stop platform 1704 (shown referring to FIG. 17) for each support arm 1200 of the plurality of support arms 304 included on tray 202. In the illustrative embodiment, right side portion 1216 and left side portion 1218 fit within right arm trough 1618 and left arm trough 1620, respectively, when support arm 1200 is in the first stop position and mounted to top plate 1100 and to base 300. Support arm fulcrum aperture 802 formed in left sidewall 804 and right sidewall 806 aligns with right fulcrum platform 1622 and left fulcrum platform 1624, respectively, when top plate 1100 is mounted to base 300. Right fulcrum portion 1208 of support arm 1200 is supported by right fulcrum platform 1622, and left fulcrum portion 1210 is supported by left fulcrum platform 1624 such that right fulcrum portion 1208 rotates on and is saddled within right fulcrum platform 1622 within support arm fulcrum aperture 802 formed in right sidewall 806, and left fulcrum portion 1210 rotates on and is saddled within left fulcrum platform 1624 within support arm fulcrum aperture 802 formed in left sidewall 804.

Figure 21:
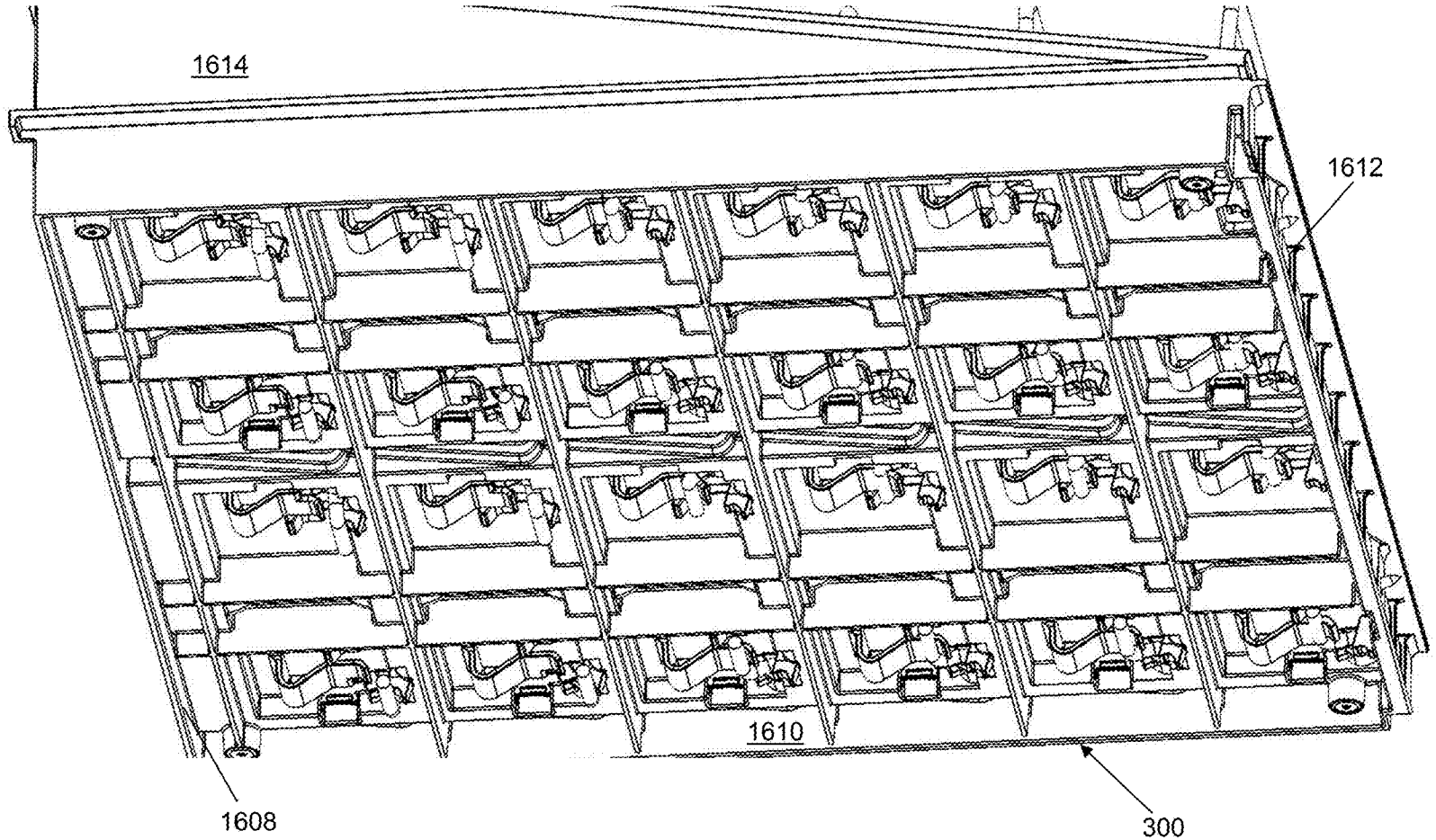
FIG. 21 depicts a bottom, left side perspective view of the tray of FIG. 3 without the bottom plate of FIG. 7 in accordance with an illustrative embodiment.
Figure 22:
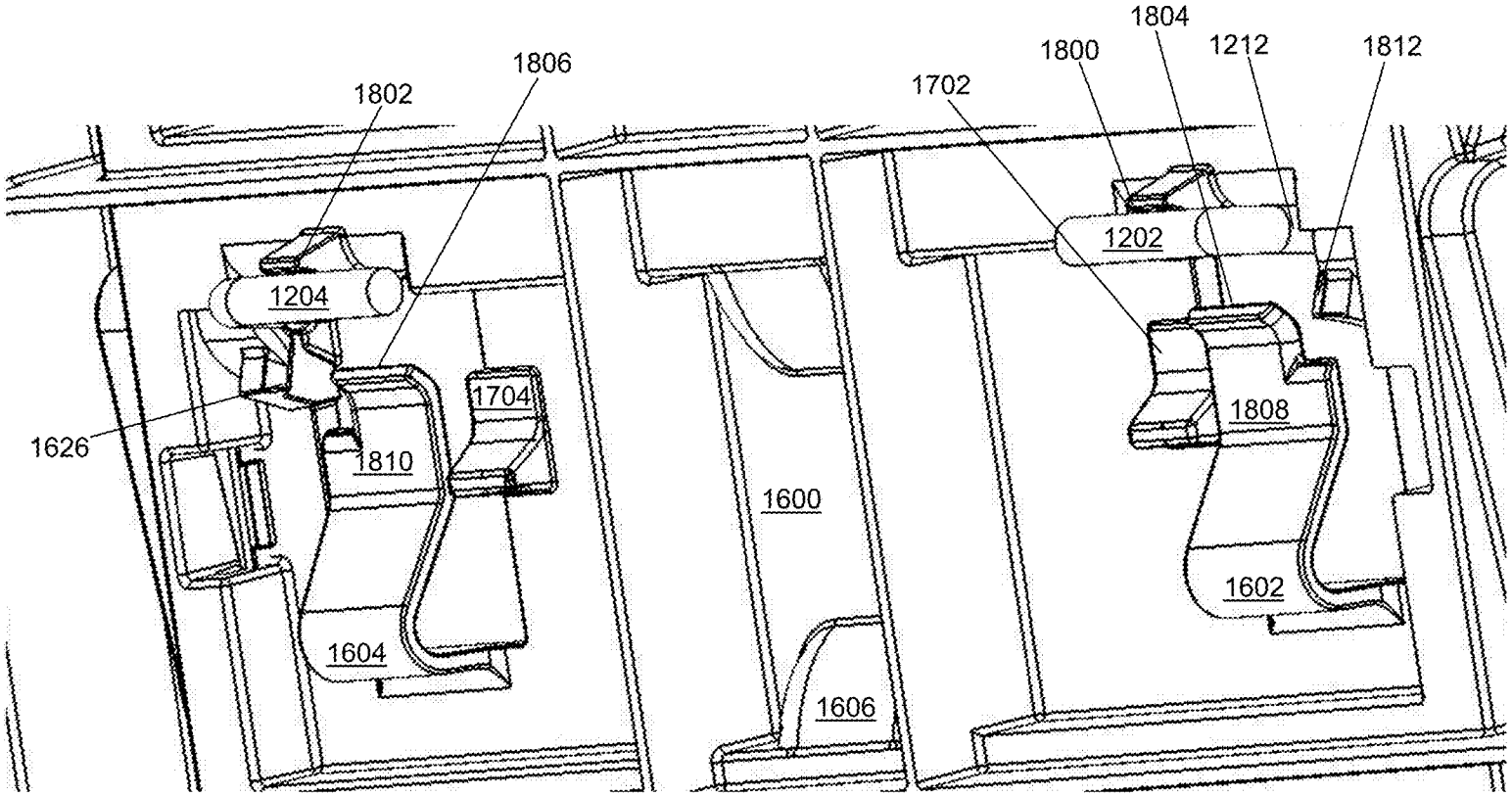
FIG. 22 depicts a zoomed bottom perspective view of the tray of FIG. 3 without the bottom plate of FIG. 7 showing the support arm in a fully lowered position in accordance with an illustrative embodiment.
Figure 23:
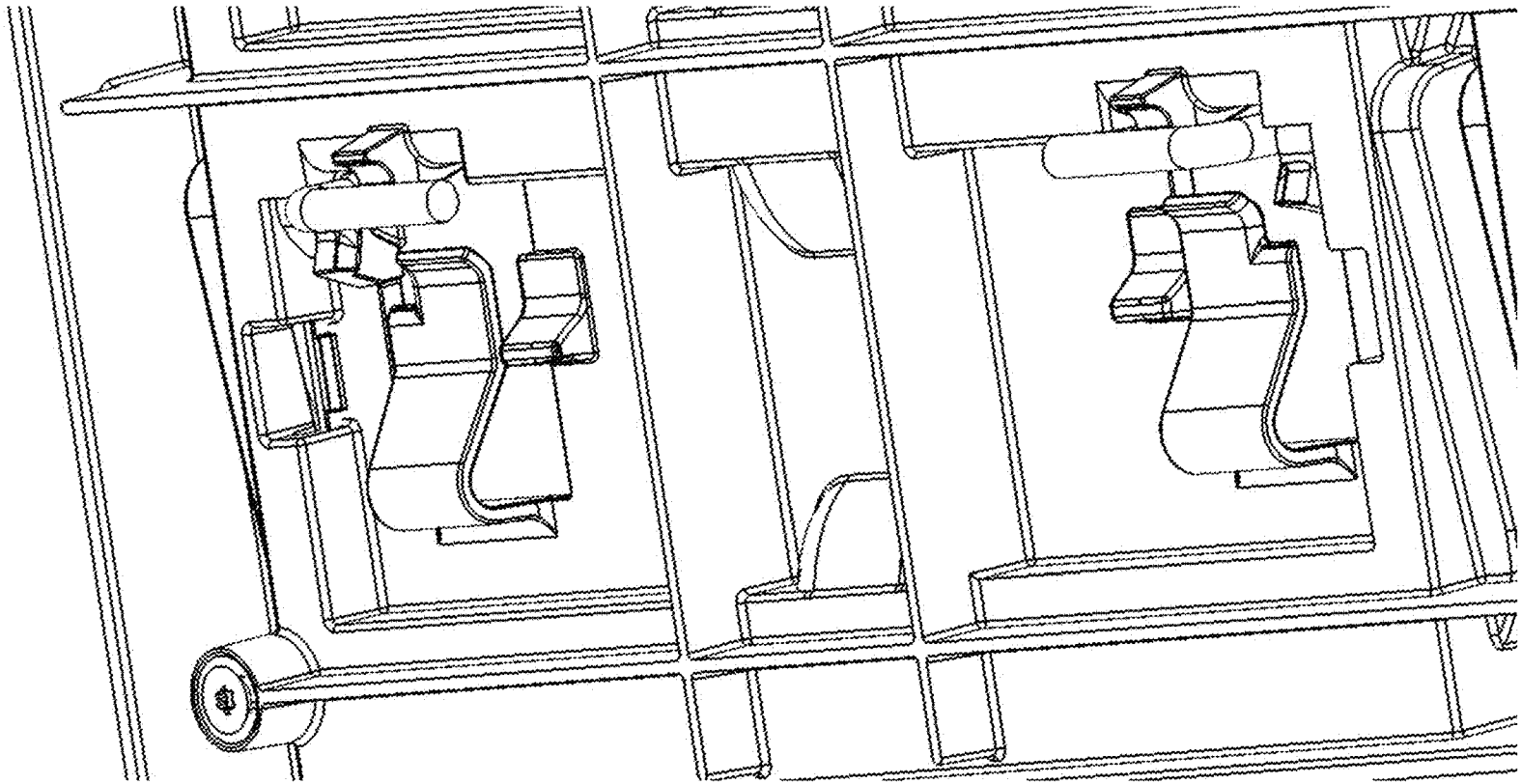
FIG. 23 depicts a zoomed bottom perspective view of the tray of FIG. 3 without the bottom plate of FIG. 7 showing the support arm in a lowered, but released position in accordance with an illustrative embodiment.
Figure 24:
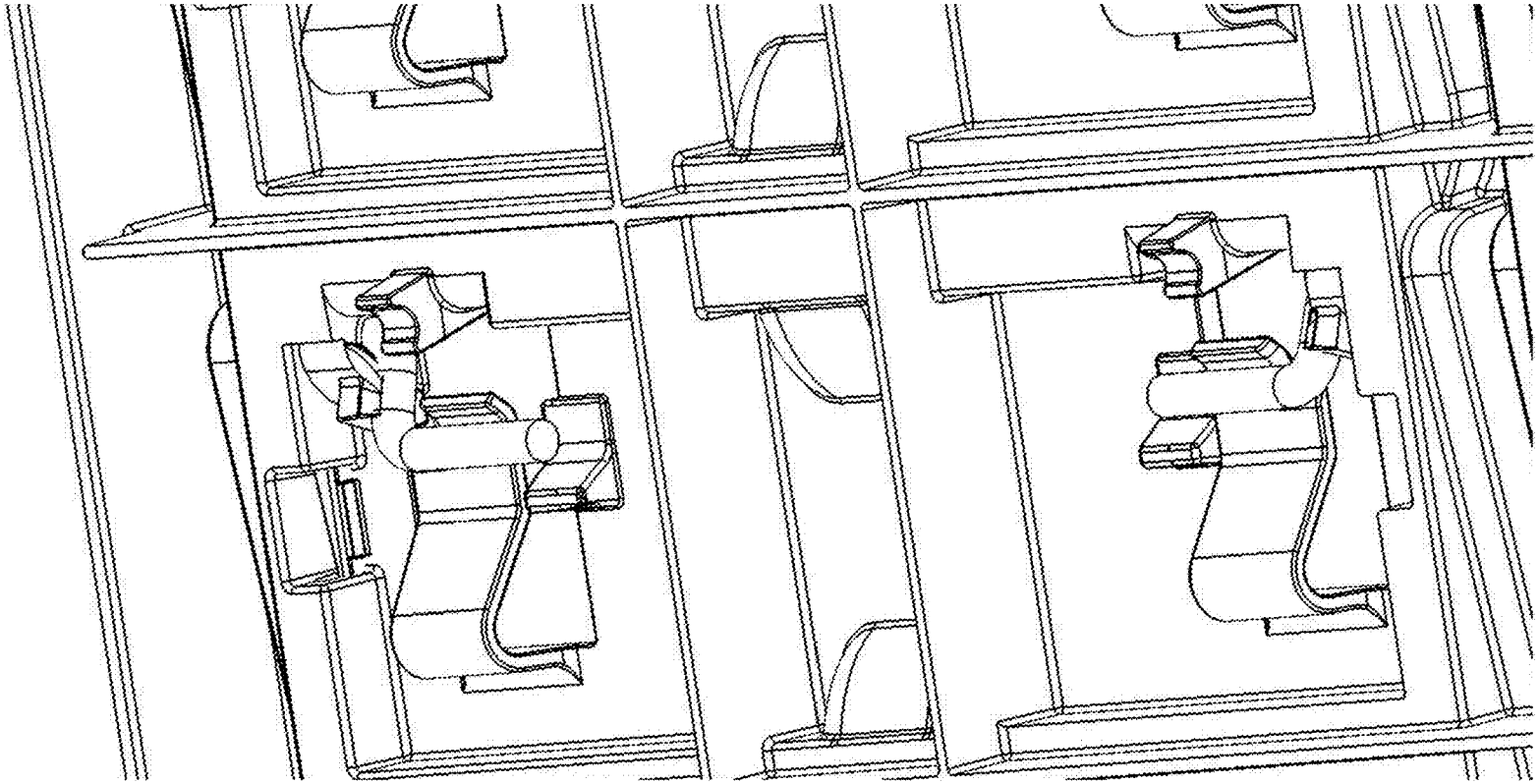
FIG. 24 depicts a zoomed bottom perspective view of the tray of FIG. 3 without the bottom plate of FIG. 7 showing the support arm in an upright position in accordance with an illustrative embodiment.
Figure 25:
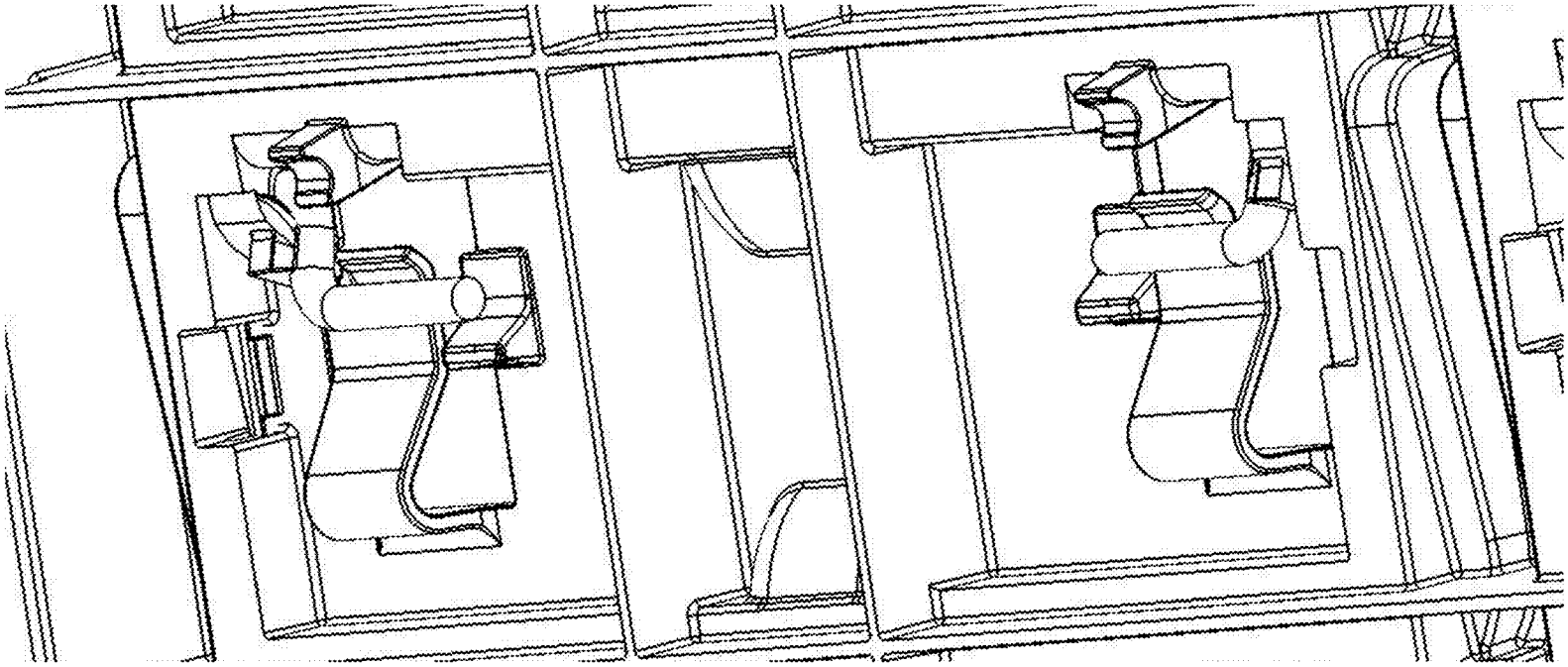
FIG. 25 depicts a zoomed bottom perspective view of the tray of FIG. 3 without the bottom plate of FIG. 7 showing the support arm in a maximally rotated upright position in accordance with an illustrative embodiment.

Referring to FIG. 21, a bottom, left side perspective view of tray 202 is shown without bottom plate 400 in accordance with an illustrative embodiment. Referring to FIG. 22, a zoomed bottom perspective view of tray 202 is shown without bottom plate 400 and showing support arm 1200 in the first stop position in accordance with an illustrative embodiment. Referring to FIG. 23, a zoomed bottom perspective view of tray 202 is shown without bottom plate 400 and showing support arm 1200 in a lowered, but released position in accordance with an illustrative embodiment. Referring to FIG. 24, a zoomed bottom perspective view of tray 202 is shown without bottom plate 400 and showing support arm 1200 in an upright position in accordance with an illustrative embodiment. Referring to FIG. 25, a zoomed bottom perspective view of tray 202 is shown without the bottom plate 400 and showing support arm 1200 in the second stop position in accordance with an illustrative embodiment.

Right hook 1202 abuts first right stop platform 1800, and left hook 1204 abuts first left stop platform 1802 when support arm 1200 reaches the first stop position as shown in FIG. 22. In the illustrative embodiment, a bottom surface of first right stop platform 1800 and a bottom surface of first left stop platform 1802 may be arc shaped to snap fit and hold right hook 1202 and left hook 1204, respectively, when support arm 1200 reaches the first stop position.

Right hook 1202 abuts second right stop platform 1702, and left hook 1204 abuts second left stop platform 1704 when support arm 1200 reaches the second stop position as shown in FIG. 25. Right hook transition portion 1212 travels down right sloped platform 1812 toward right spring 1602, and left hook transition portion 1214 travels down left sloped platform 1902 toward left spring 1604 as support arm 1200 is rotated from the first stop position to the second stop position. For example, in FIG. 23, right hook 1202 is released from first right stop platform 1800, and left hook 1204 is released from first left stop platform 1802, but has not yet contacted right sloped platform 1812 or left sloped platform 1902, respectively; whereas, in FIG. 24, right hook 1202 has traveled past right sloped platform 1812 and is in contact with a right tip 1804, and left hook 1204 has traveled past left sloped platform 1626 and is in contact with a left tip 1806, respectively.

As support arm 1200 is rotated between the first stop position and the second stop position, right hook 1202 contacts right tip 1804 of right spring 1602, and left hook 1204 contacts left tip 1806 of left spring 1604 to provide a downward spring like force against right hook 1202 and against left hook 1204, respectively, to hold support arm 1200 approximately upright. Right tip 1804 of right spring 1602 and left tip 1806 of left spring 1604 are further curved downward to further provide support to support arm 1200 in the upright position. Right hook 1202 and left hook 1204 have an upside down slide shape with length, width and depth dimensions of a material selected to provide a sufficient spring like force to counteract a weight of support arm 1200. For example, right spring 1602 and left spring 1604 may be leaf springs formed of the same material used to form base top plate 1600 such as plastic. Right spring 1602 and left spring 1604 are configured to provide a resistive force to support arm 1200 when in the upward position and to disengage with support arm 1200 when in the downward position and in support arm stop trough 800. When right hook 1202 abuts second right stop platform 1702 and left hook 1204 abuts second left stop platform 1704, right hook transition portion 1212 abuts a right flat surface 1808 of right spring 1602 adjacent second right stop platform 1702, and left hook transition portion 1214 abuts a left flat surface 1810 of left spring 1604 adjacent second left stop platform 1704 as shown in FIG. 25.

Top plate 1100 covers right spring 1602, left spring 1604, right sloped platform 1812, left sloped platform 1626, first right stop platform 1800, first left stop platform 1802, second right stop platform 1702, and second left stop platform 1704 so that they are not visible to the user. Top plate 1100 also covers right hook 1202, left hook 1204, right fulcrum portion 1208, left fulcrum portion 1210, right hook transition portion 1212, left hook transition portion 1214 so that they are not visible to the user to provide a clean appearance.

Again, as support arm 1200 rotates about the z-axis, right hook transition portion 1212 and left hook transition portion 1214 slide past a ridge of right sloped platform 1812 and of left sloped platform 1626, respectively. At the rotation angle of angle 1304 under the x-z plane, right hook transition portion 1212 and left hook transition portion 1214 rest on the upper surface of right sloped platform 1812 and of left sloped platform 1626, respectively, thus engaging right tip 1804 of right spring 1602 and left tip 1806 of left spring 1604 by right hook 1202 and left hook 1204 of support arm 1200. Right spring 1602 and left spring 1604 apply a load throughout a remained of the range of travel from the vector $P_1$ to the vector $P_3$ positions.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled relative to a front on which a door is mounted.

As used in this disclosure, the term "mount" includes join, unite, connect, couple, associate, insert, hang, hold, affix, attach, fasten, bind, paste, secure, bolt, screw, rivet, solder, weld, glue, adhere, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A tray comprising:

a plurality of support arms, wherein each support arm of the plurality of support arms comprises a top arm portion;

a right side leg portion extending downwardly from a right end of the top arm portion;

a right hook;

a right fulcrum portion mounted between the right side leg portion and the right hook;

a left side leg portion extending downwardly from a left end of the top arm portion;

a left hook; and a left fulcrum portion mounted between the left side leg portion and the left hook; and a base comprising a base top plate, the base top plate comprising a top surface, wherein each support arm of the plurality of support arms is independently rotatable with respect to the top surface between a lowered position and an upright position;

a right side wall;

a left side wall, the right side wall and the left side wall extending perpendicular and downward from the top surface;

a right plurality of fulcrum aperture walls formed in the right side wall, wherein the right fulcrum portion of each support arm of the plurality of support arms is configured to fit within a unique first aperture formed by a corresponding right fulcrum aperture wall of the right plurality of fulcrum aperture walls;

a left plurality of fulcrum aperture walls formed in the left side wall, wherein the left fulcrum portion of each support arm of the plurality of support arms is configured to fit within a unique second aperture formed by a corresponding left fulcrum aperture wall of the left plurality of fulcrum aperture walls;

a plurality of support arm troughs formed as spaced apart depressions in the top surface of the base top plate, wherein each support arm trough of the plurality of support arm troughs extends across a width of the base top plate, wherein the width of the base top plate is a distance defined from the right side wall to the left side wall; and a spring positioned below the top surface, wherein the spring is configured to contact the right hook or the left hook of the corresponding support arm of the plurality of support arms when the corresponding support arm rotates with respect to the top surface, wherein the spring supports the corresponding support arm in the upright position when the corresponding support arm is in the upright position, wherein the top arm portion of each support arm in the lowered position is received in and nested within a unique corresponding support arm trough, wherein the top arm portion of each support arm in the upright position is above and spaced from the top surface.

2. The tray of claim 1, wherein each support arm of the plurality of support arms further comprises:

a right hook transition portion between the right fulcrum portion and the right hook; and a left hook transition portion between the left fulcrum portion and the left hook.

3. The tray of claim 2, wherein each right hook transition portion extends downward and backward from a corresponding right fulcrum portion, and each left hook transition portion extends downward and backward from a corresponding left fulcrum portion.

4. The tray of claim 3, wherein the top arm portion, the right side leg portion, the right hook, the right fulcrum portion, the left side leg portion, the left hook, and the left fulcrum portion of each support arm of the plurality of support arms is formed of a single piece of material.

5. The tray of claim 3, wherein each right hook transition portion extends downward and backward from the corresponding right fulcrum portion at an angle between 91 and 120 degrees.

6. The tray of claim 1, wherein each right side leg portion is generally perpendicular to a corresponding right hook, and each left side leg portion is generally perpendicular to a corresponding left hook.

7. The tray of claim 1, wherein the upright position is between 80 and 100 degrees relative to a horizontal plane defined parallel to the base top plate.

8. The tray of claim 7, wherein the spring contacts the right hook or the left hook of the corresponding support arm only when the corresponding support arm is rotated between 85 and 95 degrees relative to the horizontal plane.

9. The tray of claim 1, wherein the spring is a leaf spring.

10. The tray of claim 1, wherein the spring is a first spring, and the first spring is configured to contact the right hook of the corresponding support arm, wherein the base further comprises:

a second spring configured to contact the left hook of the corresponding support arm when the corresponding support arm rotates with respect to the top surface.

11. The tray of claim 1, wherein the base top plate further comprises:

first finger channels formed as depressions in the base top plate, wherein each first finger channel of the first finger channels intersects with a corresponding support arm trough of the plurality of support arm troughs, wherein each first finger channel is configured to accommodate a finger to support lifting of the corresponding support arm away from the base top plate.

12. The tray of claim 11, wherein the base further comprises a base bottom plate mounted below the base top plate, wherein the base bottom plate comprises second finger channels formed as depressions in the base bottom plate, wherein each second finger channel of the second finger channels fits within a corresponding first finger channel.

13. The tray of claim 12, wherein the spring is mounted to the base bottom plate.

14. The tray of claim 12, wherein the base bottom plate further comprises:

first stop platforms on a back surface of the base bottom plate, wherein each first stop platform of the first stop platforms is configured to stop rotation of the corresponding support arm in a first direction.

15. The tray of claim 14, wherein the base bottom plate further comprises:

second stop platforms on the back surface of the base bottom plate, wherein each second stop platform of the second stop platforms is configured to stop rotation of the corresponding support arm in a second direction opposite the first direction.

16. A shelving system comprising:

a ladder;

a shelf comprising a shelf plate; and a shelf bracket mounted to the shelf plate and to the ladder; and a tray mounted to the shelf, the tray comprising a plurality of support arms, wherein each support arm of the plurality of support arms comprises a top arm portion;

a right side leg portion extending downwardly from a right end of the top arm portion;

a right hook;

a right fulcrum portion mounted between the right side leg portion and the right hook;

a left side leg portion extending downwardly from a left end of the top arm portion;

a left hook; and a left fulcrum portion mounted between the left side leg portion and the left hook; and a base comprising a base top plate, the base top plate comprising a top surface, wherein each support arm of the plurality of support arms is independently rotatable with respect to the top surface between a lowered position and an upright position;

a right side wall;

a left side wall, the right side wall and the left side wall extending perpendicular and downward from the top surface;

a right plurality of fulcrum aperture walls formed in the right side wall, wherein the right fulcrum portion of each support arm of the plurality of support arms is configured to fit within a unique first aperture formed by a corresponding right fulcrum aperture wall of the right plurality of fulcrum aperture walls;

a left plurality of fulcrum aperture walls formed in the left side wall, wherein the left fulcrum portion of each support arm of the plurality of support arms is configured to fit within a unique second aperture formed by a corresponding left fulcrum aperture wall of the left plurality of fulcrum aperture walls;

a plurality of support arm troughs formed as spaced apart depressions in the top surface of the base top plate, wherein each support arm trough of the plurality of support arm troughs extends across a width of the base top plate, wherein the width of the base top plate is a distance defined from the right side wall to the left side wall; and a spring positioned below the top surface, wherein the spring is configured to contact the right hook or the left hook of the corresponding support arm of the plurality of support arms when the corresponding support arm rotates with respect to the top surface, wherein the spring supports the corresponding support arm in the upright position when the corresponding support arm is in the upright position, wherein the top arm portion of each support arm in the lowered position is received in and nested within a unique corresponding support arm trough, wherein the top arm portion of each support arm in the upright position is above and spaced from the top surface.

17. The shelving system of claim 16, wherein the spring is a first spring, and the first spring is configured to contact the right hook of the corresponding support arm, wherein the base further comprises:

a second spring positioned below the top surface, wherein the second spring is configured to contact the left hook of the corresponding support arm when the corresponding support arm rotates with respect to the top surface.

18. The shelving system of claim 16, wherein the base further comprises a base bottom plate mounted below the base top plate, wherein the base bottom plate comprises:

first stop platforms on a back surface of the base bottom plate, wherein each first stop platform of the first stop platforms is configured to stop rotation of the corresponding support arm in a first direction.

19. The shelving system of claim 18, wherein the base bottom plate further comprises:

second stop platforms on the back surface of the base bottom plate, wherein each second stop platform of the second stop platforms is configured to stop rotation of the corresponding support arm in a second direction opposite the first direction.

20. The shelving system of claim 16, wherein the spring contacts the right hook or the left hook of the corresponding support arm only when the corresponding support arm is rotated between 85 and 95 degrees relative to a horizontal plane parallel to the base top plate.

* * * * *